US007118353B2

(12) United States Patent
Maruyama et al.

(10) Patent No.: US 7,118,353 B2
(45) Date of Patent: Oct. 10, 2006

(54) FLUID TRANSPORT SYSTEM AND METHOD THEREFOR

(75) Inventors: Teruo Maruyama, Hirakata (JP); Keigo Kusaka, Akashi (JP); Miyuki Furuya, Hirakata (JP); Kazuichi Yamashita, Matsue (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 411 days.

(21) Appl. No.: 10/463,601

(22) Filed: Jun. 18, 2003

(65) Prior Publication Data

US 2004/0033153 A1 Feb. 19, 2004

(51) Int. Cl.
*F04B 23/00* (2006.01)
*F04B 39/00* (2006.01)
*F04B 53/00* (2006.01)

(52) U.S. Cl. ..... 417/313; 417/423.1

(58) Field of Classification Search ..... 417/201.1, 417/313, 423.1; 604/151, 152, 153
See application file for complete search history.

(56) References Cited

U.S. PATENT DOCUMENTS 4,144,163 A * 3/1979 Kolm ..... 209/12.2
5,088,899 A * 2/1992 Blecker et al. ..... 417/356
5,678,306 A * 10/1997 Bozeman et al. ..... 29/888.025
6,447,265 B1 * 9/2002 Antaki et al. ..... 417/354
6,506,025 B1 * 1/2003 Gharib ..... 417/53
6,582,208 B1 * 6/2003 Gharib ..... 417/423.1
2001/0002976 A1 * 6/2001 Skill ..... 417/410.3
2002/0044867 A1 * 4/2002 Gharib ..... 415/90
2004/0136846 A1 * 7/2004 Gharib ..... 417/423.1
2005/0008510 A1 * 1/2005 Gerstenberg ..... 417/410.4

FOREIGN PATENT DOCUMENTS

JP 2002-39569 2/2002

* cited by examiner

*Primary Examiner*—William H. Rodriguez
(74) *Attorney, Agent, or Firm*—Wenderoth, Lind & Ponack, L.L.P.

(57) ABSTRACT

A reduced pressure or pressurizing pump is provided which can be used in a wide variety of fields of foods, pharmaceuticals, medical treatment, agriculture, healthcare equipment, room air conditioning, combustion, biotechnology, and so on. By the application of the pump of the present invention, there can be materialized, for example, an oxygen enriching apparatus or a nitrogen enriching apparatus, which have the features of an oil-free structure, a small size, compactness, low vibration, low noise, long operating life, and so on. A transport groove of a viscosity pump, which exerts a force feed action on the fluid, is formed at a relative displacement interface between a rotor and a housing, and the rotor supported by a bearing capable of coping with a high-speed rotation is rotated at a high speed.

9 Claims, 16 Drawing Sheets

FLUID TRANSPORT SYSTEM AND METHOD THEREFOR

BACKGROUND OF THE INVENTION

1. Field of the Invention

The present invention relates to a fluid transport system that has a built-in pump for use in a wide variety of fields of air conditioning machines, refrigerators, air conditioners, oxygen water purifiers, combustors and so on, and a method therefor.

2. Description of the Related Art

Recently, there have been increasing needs for oil-free dry pumps in various fields. The dry pump is defined as a vacuum pump that can perform exhaustion with its outlet port being kept connected to the atmosphere using neither oil nor liquid at the gas passage of the pump. The dry pump is a mechanical vacuum pump of a new type, which has been developed first in Japan in the late 1980's and which has become rapidly widespread mainly in the semiconductor industry.

There have recently been growing demands for improving the vacuum pumps for semiconductor manufacturing processes in order to cope with higher integration density and finer structures. The demands mainly include the contents of 1) obtaining a high ultimate vacuum pressure, 2) cleanness, 3) easy maintenance and 4) small size and compactness. In order to respond to the demands, dry vacuum pumps for roughing have been widely used for the purpose of obtaining a cleaner vacuum in place of oil-sealed rotary vacuum pumps, which have been conventionally used. A number of types of pumps have been developed and put to practical use, where such pumps include positive displacement types of a screw type, a claw type, a scroll type, a multistage root type and so on as well as a kinetic type of a turbo type.

FIG. 16 shows a dry vacuum pump of a thread groove type (a kind of screw type), which is a kind of a conventional positive displacement vacuum pump (roughing vacuum pump).

FIG. 16 illustrates a housing 101, a first rotary shaft 102, a second rotary shaft 103, and cylindrical rotors 104 and 105 which are connected to the first and second rotary shafts 102 and 103, respectively. Thread grooves 106 and 107 are formed on the outer peripheral portions of the rotors 104 and 105, respectively, and by meshing the recess portion of one thread groove with the protruding portion of the other thread groove, a hermetic space is produced between them. If the rotors 104 and 105 rotate, the hermetic space then shifts from the suction side to the discharge side in accordance with the rotation, exerting a sucking action and a discharge action.

In the vacuum pump of the thread groove type of FIG. 16, synchronous rotation of the two rotors 104 and 105 is achieved by timing gears 110*a* and 110*b*. That is, the rotation of the motor 108 is transmitted from a driving gear 109*a* to an intermediate gear 109*b* and is transmitted to one gear 110*b* of the timing gears that are provided on the shafts of both rotors 104 and 105 and meshed with each other. The rotation angle phases of both the rotors 104 and 105 are adjusted by the meshing engagement of these two timing gears 110*a* and 110*b*. FIG. 16 also illustrates rolling bearings 113*a*, 113*b* and 114*a*, 114*b*, which support the first rotary shaft 102 and the second rotary shaft 103, respectively.

FIG. 16 also illustrates a built-in oil pump 115 at the end portion of the driving gear 109*b*, an oil pan 116 in a lowermost portion of the pump, oil 117, a suction chamber 118, a mechanical seal 119, and a fluid transfer chamber 120.

FIG. 17 shows a turbo type dry vacuum pump, which is a kind of a conventional kinetic vacuum pump.

FIG. 17 illustrates a rotor 200 located on the rotary side, a stator 201 located on the stationary side, a downstream side pump 202 that is called the vortex flow component and formed between the rotor 200 and the stator 201, an upstream side pump 203 called the centrifugal component, and an upper casing 204 that houses the rotor 200 and the stator 201. FIG. 17 also illustrates a rotary shaft 205 connected to the rotor 200, ball bearings 206*a* and 206*b*, a high-frequency motor rotor 207, a stator 208 of the motor rotor 207, an inlet port 209, an outlet port 210, an oil cooler 211, a lower casing 212, an intermediate casing 213, and a seal portion 214 provided between the intermediate casing 213 and the rotary shaft 205.

In the above-mentioned dry pump, a turbine wheel of the vortex flow component pump that is capable of obtaining a high compression ratio in a viscous flow is arranged on the outlet port side connected to the atmosphere, while a centrifugal component pump that operates as a molecular drag pump in a molecular flow is arranged on the inlet port side. A diaphragm type dry vacuum pump, which is a kind a of positive displacement type vacuum pump, is widely used as a means for performing suction and transport of fluid in a clean state. The diaphragm type pump is used as a comparatively small displacement means for transporting fluid since the pump is able to perform suction, compression, and discharge of fluid in a hermetic space completely isolated from the drive sections of the motor, bearings and so on.

Recently, there have been increasing needs for clean vacuum transport in the fields of, for example, foods, pharmaceuticals, agriculture, and healthcare equipment besides the aforementioned semiconductor processes. For example, a technology for enriching oxygen in the air by using a polymer gas separation membrane (oxygen enriching membrane) has become widespread and utilized for medical treatment, air conditioning in a room, or industrial uses related to combustion and biotechnology besides the aforementioned foods, pharmaceuticals, agriculture, and healthcare equipment.

A known oxygen enriching apparatus, as shown by example in FIG. 18, is provided with an oxygen enriching module 301 for selectively separating oxygen from the atmosphere, a vacuum pump 302 for obtaining oxygen-enriched air by reducing the internal pressure of the module 301, an air blower fan (means) 303 for supplying air into the module 301, and a dehumidifying unit 304 for removing steam and moisture from the oxygen-enriched air.

The oxygen enriching module 301 is provided with, for example, an oxygen enriching membrane of a composite material constructed mainly of polydimethylsiloxane and has a permeability rate of oxygen that is faster than that of nitrogen and a much faster permeability rate of steam. The vacuum pump (reduced pressure pump) 302 is used for reducing the internal pressure of the oxygen enriching module 301, providing a pressure difference between the inside and the outside of the membrane and obtaining oxygen-enriched air. The air blower fan 303 operates to form airflow, supply air to the oxygen enriching module 301 and remove steam from the periphery of the dehumidifying unit 304. Moreover, the dehumidifying unit 304 is provided on the discharge side of the vacuum pump 302 and is constructed so that it internally has a passage of oxygen-enriched air and is arranged in an airflow produced by the air blower means 303.

The oxygen enriching module is a well-known material which is capable of obtaining the oxygen-enriched air by utilizing the principle that oxygen, which is located on the atmospheric side and dissolved in the surface of the membrane, is diffused and moved inside the membrane and separated from the membrane surface on the reduced pressure side by providing a pressure difference between both surfaces of the separation membrane. For example, under the condition of a reduced pressure level of −560 mmHg (−74.5 KPa), the normal air of $N_2$: 79% and $O_2$: 21% becomes the oxygen-enriched air of $N_2$: 68% and $O_2$: 32% by permeating through the oxygen enriching module. The module has the characteristics of an easily obtainable large flow rate, a stabilized oxygen concentration, a light weight, a low consumption of power and so on.

As the uses of the oxygen enriching apparatus, there is, for example, an oxygen inhaler for medical use, healthcare use and first aid use. As a method for obtaining oxygen gas, it is a general practice to fill a portable container with oxygen gas separated by low-temperature separation, and there is demanded a low-cost portable oxygen inhaler which makes best use of the features of the oxygen enriching module and is able to be filled with oxygen handily and easily without frequency limitation.

Moreover, it is possible to conversely make the aforementioned hermetic space nitrogen rich by extracting oxygen $O_2$ from the atmosphere in the hermetic space by utilizing the principle of this oxygen enriching membrane.

This nitrogen enriching apparatus has a use for food preservation to prevent the oxidation of foods. For example, there is an earnest demand for forming a nitrogen-enriched space in a refrigerator to maintain the freshness of foods of, for example, vegetable, fish, and meat for a long time.

As to other uses, uses have been developed for countermeasures against dioxin in processing industrial waste by oxygen-enriched high-temperature combustion, $CO_2$ reduction combustion for combustion with a reduced amount of fuel, an air purifier and an air conditioner intended for the creation of an oxygen-enriched room, and so on.

In the case where the aforementioned system has been constructed for the purpose of creating an oxygen-enriched or nitrogen-enriched air, the common subjects required for the vacuum pump (or pressurizing pump), which has been the important key unit of the system, has been, for example, as follows.

(1) A displacement Q is required to be about 0.5 to 6 l/min, and a vacuum pressure P at the operating point is required to be, for example, −600 mmHg to −400 mmHg (−80 KPa to −53 KPa).

(2) The structure is required to be as simple and compact as possible.

(3) Low vibration and silence are required.

(4) A long operating life is required.

Furthermore, in addition to the above-mentioned requirements (1) through (4), in the case of an oxygen enriching apparatus for medical treatment and healthcare or a nitrogen enriching apparatus for food preservation, the vacuum pump is required to be:

(5) completely oil free.

That is, the use of machine oil is kept at a distance from any portion that communicates with the exhaustion space of the pump. When a vacuum pump is applied to an air conditioning machine, air conditioner, or the like, the level of cleanness required for the vacuum pump is considered to roughly correspond to the above although the level is less significant than in the case of medical treatment, healthcare, and foods.

A vacuum pump, which concurrently satisfies the aforementioned requirements (1) through (4) or (1) through (5), cannot be found conventionally. If such a vacuum pump is materialized, it is expected that the pump will be an initiator for rapidly popularizing the oxygen enriching apparatus.

Assuming the dry vacuum pump that is widespread mainly in the semiconductor industry is replaced with a vacuum pump of the aforementioned oxygen enriching apparatus following the driving principle and the fundamental structure of the dry vacuum pump, there have been the following issues that have not been able to be easily solved. One of the issues is the relation between displacement and an ultimate vacuum pressure.

In the case of the positive displacement pump, the relation between displacement and efficiency or between displacement and the ultimate vacuum pressure is not linear. The smaller the displacement, the further the efficiency and the ultimate vacuum pressure becomes extremely reduced. The reason for the above is that the processing and assembling accuracies of the members that constitute the pump cannot be proportionally improved even if the pump body and the components are reduced in size. Taking the case of the thread groove type dry vacuum pump, which is the aforementioned positive displacement type vacuum pump, as an example, a ratio of occupation of the total amount of internal leak of gas that passes through a gap between the two rotors 104 and 105 or a gap between the rotor and the housing 101 with respect to the closed transport space increases extremely as the displacement reduces. When the speed of the rotor rotation is increased in order to reduce the influence of the internal leak as far as possible, there emerges new issues of an increase in the amount of generated heat and a reduction in the operating life of a seal in a mechanical seal portion 119 that accompanies a mechanical sliding friction, an increase in torque, vibrations of the timing gear portions 110*a* and 110*b*, and so on.

In other words, it is not easy to replace the vacuum pump for a semiconductor, which normally has a displacement of not smaller than 500 l/min, with a clean pump that can obtain a pressure P of −600 mmHg to −400 mmHg (−80 KPa to −53 KPa) with a displacement of about 1/100 while scaling down the dimensions and weight in correspondence with the displacement and maintaining a low consumption of power, following the fundamental structure of the vacuum pump.

Another issue is to make the pump free of oil. The thread groove type dry vacuum pump, which is the aforementioned positive displacement type vacuum pump, has a construction in which a gap of normally tens of micrometers can be kept at the portion where the two thread groove rotors 104 and 105 mesh with each other or between the rotor and the casing 101 in FIG. 16. Since a relative phase relation between the two rotors is kept by the timing gears 110*a* and 110*b*, there is no mechanical slide portion in the fluid transport space, and clean exhaustion can be achieved. However, oil lubrication is required for the one pair of timing gears and bearings. Oil 117 for this lubrication is sucked from an oil pan 116 located in a lowermost portion of the pump by the oil pump and is supplied to the bearings and the gears via an oil filter. A mechanical seal 119 is provided so as to prevent the oil from flowing into the fluid transfer chamber 120 that houses the thread groove rotor and to prevent the reactive gas transported inside the fluid transfer chamber 120 from intruding into the oil storage space. Other 2-rotor pump types of, for example, the root type, the Wankel type, and the claw type have roughly similar fundamental structures in the portions that need lubrication.

The turbo type dry vacuum pump (FIG. 17), which is the aforementioned kinetic vacuum pump, is driven to rotate normally at a velocity of several tens of thousands of revolutions per minute. In the case of the pump of this type, the timing gear employed in the positive displacement type is not necessary, but oil lubrication to the ball bearing portions is still indispensable. Moreover, a seal means for isolation between the portions that need lubrication with oil and the clean fluid transport space is also necessary.

That is, in the dry pump for semiconductor processes, regarded as oil free, the fluid transport space is merely isolated from the oil-rich space by the mechanical seal means, and there is no change from the conventional pump with regard to the fact that oil for lubrication is the indispensable condition of the pump drive section.

Here, the propriety of reducing the size of the pump constructed as described above by scaling down and the application thereof to clean pumps for healthcare, medical equipment and foods or, for example, an oxygen inhaler for supplying oxygen to a person, an oxygen water purifier for producing oxygen water by bubbling oxygen in a water tank, food preservation for preventing the oxidation of foods by making a refrigerator room internally nitrogen rich, and so on are considered. Even if the fluid transport space can be kept physically completely clean, the fact that the oil-rich space filled with machine oil exists in the neighborhood via a mechanical seal cannot be sensuously unacceptable in an aspect.

In other words, it is extremely difficult to replace the vacuum pump for a semiconductor, which normally has a displacement of not smaller than 500 l/min, with a clean pump for foods, pharmaceuticals, medical treatment, healthcare equipment, and so on to keep a displacement of about 1/100 following the fundamental structure of the vacuum pump.

The diaphragm type dry vacuum pump that is the positive displacement type vacuum pump, which can suck and discharge fluid in a clean hermetic space completely isolated from the drive sections of motors, bearings, and so on, has therefore been the only pump which can be capable of resolving the aforementioned issues. Moreover, the pump is good at exhaustion at a comparatively small flow rate. However, the pump has had the following drawbacks.

(1) Vibration and noise are large.

(2) The pump body is increased in size due to poor pump efficiency.

(3) Operating life is short because of fatigue due to repetitive stress application to the diaphragm membrane.

(4) A low ultimate vacuum pressure cannot be obtained.

The noise of the item (1) is dominated by a pulsation sound of air discharged by intermittent driving. The poor efficiency of the item (2) is attributed to the positive displacement vacuum pump driving principle that the power of the piston in either the suction or discharge stroke does not work as a regenerating action. The item (3) becomes a fatal drawback in supposed application to, for example, a consumer use refrigerator, which must continuously operate for many years regardless of day and night.

In short, a pump, which is able to perform clean exhaustion completely free of oil similar to the diaphragm type pump and to remove the aforementioned drawbacks of the diaphragm type, does not exist conventionally. Accordingly, the appearance of a new pump is necessary and expected.

In view of the aforementioned conventional problems, an object of the present invention is to provide a noncontact completely oil-free fluid transport system by supporting a viscosity pump with a hydrodynamic gas bearing and a method therefor.

In order to achieve the aforementioned object, the fluid transport system of the present invention is constituted of a fluid transport system, which includes a pump constructed of a rotor housed in a housing, a bearing for supporting the rotation of this rotor, a fluid transfer chamber formed of the rotor and the housing, fluid inlet and outlet ports that are formed at the housing and communicate with the fluid transfer chamber, a motor for rotatively driving the rotor, and a transport groove that is formed at a relative displacement interface between the rotor and the housing and exerts a fluid pumping action.

SUMMARY OF THE INVENTION

In accomplishing these and other aspects, a first aspect of the present invention provides a fluid transport system which comprises: a rotor housed in a housing; a bearing for supporting rotation of the rotor, a fluid transfer chamber formed of the rotor and the housing, fluid inlet and outlet ports which are formed at the housing and are each for communicating with the fluid transfer chamber; and a motor for rotatively driving the rotor. A transport groove for exerting a fluid pumping action on fluid is formed at a relative displacement interface between the rotor and the housing, and an isolative function membrane is arranged along a fluid passage.

A second aspect of the present invention provides a fluid transport system which comprises: a rotor housed in a housing; a bearing for supporting rotation of the rotor, a fluid transfer chamber formed of the rotor and the housing, fluid inlet and outlet ports which are formed at the housing and are each for communicating with the fluid transfer chamber; and a motor for rotatively driving the rotor. A transport groove for exerting a fluid pumping action on fluid is formed at a relative displacement interface between the rotor and the housing.

A third aspect of the present invention provides the fluid transport system as defined in the second aspect, wherein the transport groove is a hydrodynamic groove for utilizing a hydrodynamic effect of the fluid being viscous.

A fourth aspect of the present invention provides the fluid transport system as defined in the second aspect, wherein two transport grooves of different passages for transporting the fluid are formed at the relative displacement interface.

A fifth aspect of the present invention provides the fluid transport system as defined in the fourth aspect, comprising a structure of sucking the fluid from a common portion where the two transport grooves are adjacently located, for making the fluid diverge and discharging the fluid through the respective transport grooves.

A sixth aspect of the present invention provides the fluid transport system as defined in the fourth aspect, wherein the two transport grooves are formed so that pressures at both axial end portions of the rotor become roughly equal to each other.

A seventh aspect of the present invention provides the fluid transport system as defined in the second aspect, wherein the transport groove is formed at a relative displacement interface between a disk integrated with the rotor and the housing in a thrust direction of the rotor.

An eighth aspect of the present invention provides the fluid transport system as defined in the second aspect, comprising a structure in which a discharge side passage of the fluid transfer chamber communicates with an opening portion of a space for housing the bearing.

A ninth aspect of the present invention provides the fluid transport system as defined in the second aspect, wherein the bearing is a hydrodynamic fluid bearing.

A tenth aspect of the present invention provides the fluid transport system as defined in the ninth aspect, wherein the hydrodynamic fluid bearing is a hydrodynamic gas bearing.

An eleventh aspect of the present invention provides the fluid transport system as defined in the ninth aspect, wherein a hydrodynamic groove of the hydrodynamic fluid bearing is formed at a relative displacement interface between an outer surface of a stationary shaft and an inner surface of the rotor.

A twelfth aspect of the present invention provides the fluid transport system as defined in the eleventh aspect, wherein a pivot bearing for supporting a thrust direction of the rotor is arranged in an end portion on an opening side of the stationary shaft.

A thirteenth aspect of the present invention provides the fluid transport system as defined in the second aspect, wherein the bearing is a hydrostatic gas bearing.

A fourteenth aspect of the present invention provides the fluid transport system as defined in the ninth or thirteenth aspect, wherein gas being transported by a pump and gas being used for lubrication of the bearing are the same gas.

A fifteenth aspect of the present invention provides the fluid transport system as defined in the ninth or thirteenth aspect, wherein a space in which the transport groove is formed is connected to a space in which the bearing is housed in terms of a fluid path.

A sixteenth aspect of the present invention provides the fluid transport system as defined in the second aspect, wherein the bearing is comprised of a bearing A and a bearing B, and assuming that a position in a z-direction of an intermediate portion of the bearing A is $Z_{B1}$, a position in the z-direction of an intermediate portion of the bearing B is $Z_{B2}$, a position on the bearing A-side in the z-direction of an end portion of the transport groove is $Z_{P1}$, and a position on the bearing B-side in the z-direction is $Z_{P2}$, then there is a portion where an interval of $Z_{B2} \leqq Z \leqq Z_{B1}$ overlaps with an interval Of $Z_{P2} \leqq Z \leqq Z_{P1}$.

A seventeenth aspect of the present invention provides the fluid transport system as defined in the second aspect, wherein the rotor has a number of revolutions of not smaller (less) than 20,000.

An eighteenth aspect of the present invention provides the fluid transport system as defined in the second aspect, wherein a gap of the relative displacement interface between the rotor and the housing, where the transport groove is formed, is not greater than 15 μm.

A nineteenth aspect of the present invention provides the fluid transport system as defined in the second aspect, wherein the transport groove has a groove depth of not greater than 150 μm.

A twentieth aspect of the present invention provides the fluid transport system as defined in the second aspect, wherein the pump is used as a reduced pressure means or compression means of an isolative function membrane, which is arranged along a fluid passage, for passing oxygen more easily than nitrogen.

A twenty-first aspect of the present invention provides the fluid transport system as defined in the twentieth aspect, wherein the isolative function membrane is an oxygen enriching membrane.

A twenty-second aspect of the present invention provides the fluid transport system as defined in the twentieth aspect, wherein a dust filter for preventing particles of a diameter equal to or greater than a prescribed particle diameter from intruding into the pump is arranged on an upstream side of the pump connected to the inlet port.

A twenty-third aspect of the present invention provides the fluid transport system as defined in the twentieth aspect, concurrently having a function of the dust filter and a function of the isolative function membrane.

A twenty-fourth aspect of the present invention provides the fluid transport system as defined in the twentieth aspect, wherein the pump is used as a means for making a nitrogen-enriched space on an upstream side of the isolative function membrane.

A twenty-fifth aspect of the present invention provides the fluid transport system as defined in the twentieth aspect, comprised of: an oxygen enriching membrane module; a pump, which is arranged on a downstream side of the oxygen enriching membrane module, for reducing a pressure of the oxygen enriching membrane module; and an object to be supplied with oxygen-enriched air, where the object is arranged on a downstream side of the pump.

A twenty-sixth aspect of the present invention provides the fluid transport system as defined in the twenty-fifth aspect, wherein the object of supply is any one of an oxygen water purifier, an oxygen inhaler, a room or car air conditioner, a hot combustor, and oxygen effect application equipment.

A twenty-seventh aspect of the present invention provides the fluid transport system as defined in the twentieth aspect, comprised of: an oxygen enriching membrane module; a pump, which is arranged on a downstream side of the oxygen enriching membrane module, for reducing a pressure of the oxygen enriching membrane module; and a nitrogen-enriched space arranged on an upstream side of the oxygen enriching membrane module.

A twenty-eighth aspect of the present invention provides the fluid transport system as defined in the twenty-seventh aspect, wherein the nitrogen-enrich space is a refrigerator.

A twenty-ninth aspect of the present invention provides a fluid transport method for obtaining oxygen-enriched air or nitrogen-enriched air by sucking air via an isolative function membrane, which is arranged in a fluid passage, for passing oxygen more easily than nitrogen, by utilizing a suction effect which is generated as a consequence of the rotation of a transport groove formed at a relative displacement interface between a rotor supported on a noncontact bearing and a housing that houses the rotor.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
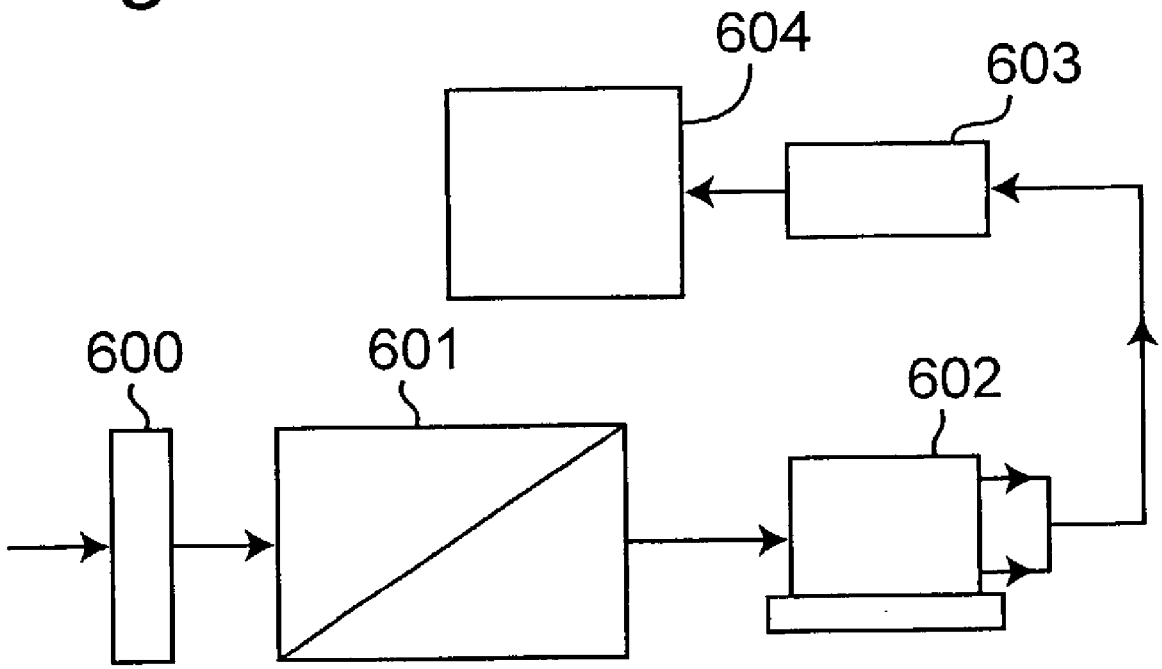
FIG. 1 is a view showing one example of an oxygen enriching system with a built-in pump of the present invention.

Before the description of the present invention proceeds, it is to be noted that like parts are designated by like reference numerals throughout the accompanying drawings.

FIG. 1 shows one example of an oxygen enriching apparatus to which the pump and the fluid transport system of the present invention are applied. FIG. 1 illustrates an air blower fan 600, an oxygen enriching membrane module 601 of which oxygen concentrations at an inlet side and an outlet side are different from each other, a reduced pressure pump (vacuum pump) 602, a dehumidifying unit 603, and an object 604 to be supplied with oxygen-enriched air. The above-mentioned members 600 through 604 are the pump and the fluid transport system of the object to which the present invention is applied. As the object 604 to be supplied with oxygen-enriched air, there are enumerated an oxygen water purifier for readily making oxygen water; an oxygen inhaler for medical care, healthcare, and first aid; a room or car air conditioner for making a comfortable space; a jet bath; a high-temperature combustor; and so on. The oxygen enriching membrane module 601 concurrently functions as a dust filter of the reduced pressure pump 602, and fine particles having an outside diameter of not smaller (less) than 0.1 μm do not intrude into the exhaustion passage of the thread groove pump.

Figure 2A:
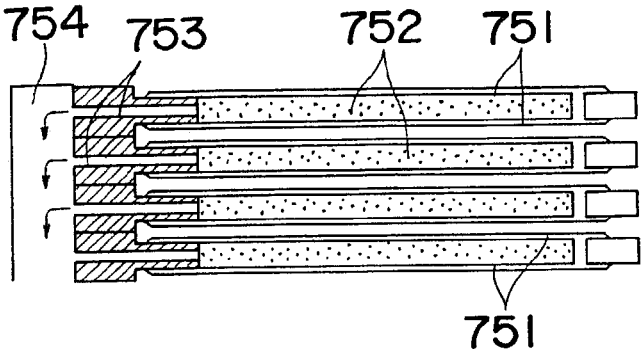
FIGS. 2A and 2B are views showing one example of an oxygen enriching membrane module.
Figure 2B:
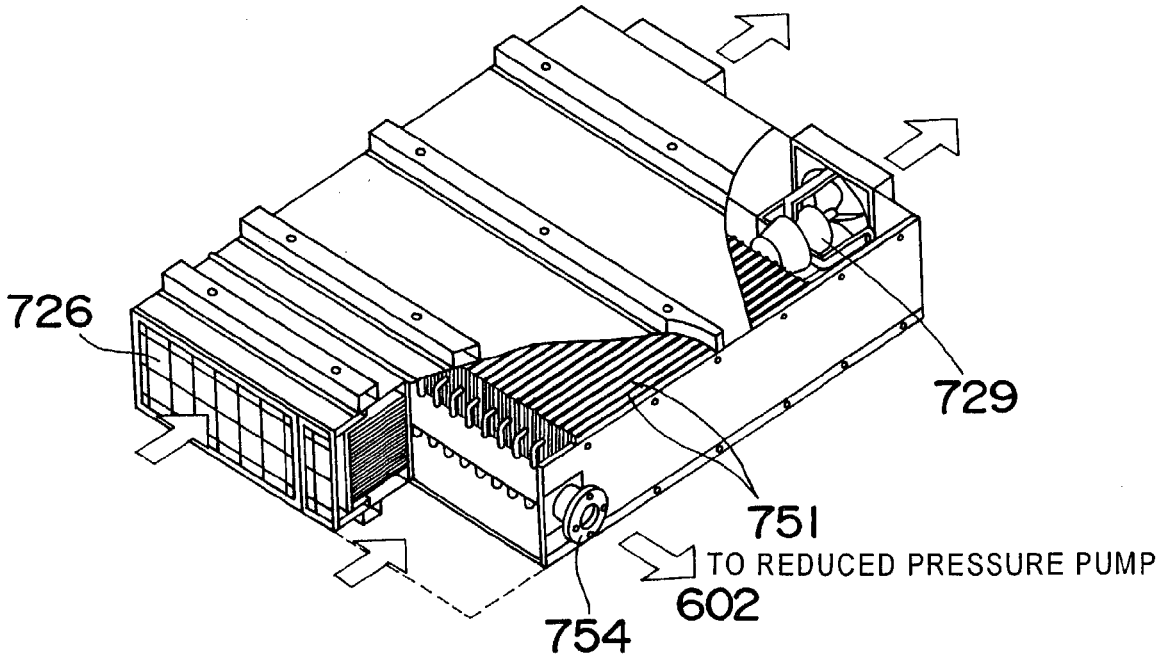

FIGS. 2A and 2B show one example of the oxygen enriching membrane module 601. There are shown oxygen enriching membranes 751, multiporous support plates 752, narrow pipes 753, and a drainpipe 754. A fan 729 is provided in a rear portion of the module 601, and outside air flows inside the multiporous support plates 752 from a front portion to the rear portion of the module 601. In order to remove dust in the outside air, a filter 726 is provided in the front portion of the multiporous support plates 752. Although FIG. 2B shows the built-in fan 729 of the module 601, this fan 729 may be provided outside the module 601 so long as the air inside the module 601 can be discharged.

The air, which has passed through the filter 726, is supplied to an oxygen enriching module (hereinafter occasionally referred to simply as a "module"). In this oxygen enriching module 601, two oxygen enriching membranes 751 are arranged parallel and apart from each other while keeping a gap of a prescribed thickness. In order to keep the gap of the prescribed thickness, these two oxygen enriching membranes 751 are laminated on both sides of the one multiporous support plate 752. The narrow pipe 753 is connected to each end portion of this multiporous support plate 752. The periphery of each multiporous support plate 752 except for the portion to which the narrow pipe 753 is connected is sealed so that there are no gas leaks or other intrusions. All of the narrow pipes 753 communicate with the one drainpipe 754, and this drainpipe 754 is connected to a reduced pressure pump 602.

The present invention will be described below separately in the following two cases.

(1) In the case of a completely oil-free pump (2) In the case where the use of some quantity of oil for bearing lubrication is permitted in correspondence with the above-mentioned completely oil-free case.

The above-mentioned case (1) will be described with reference to FIGS. 3 and 4.

Figure 3:
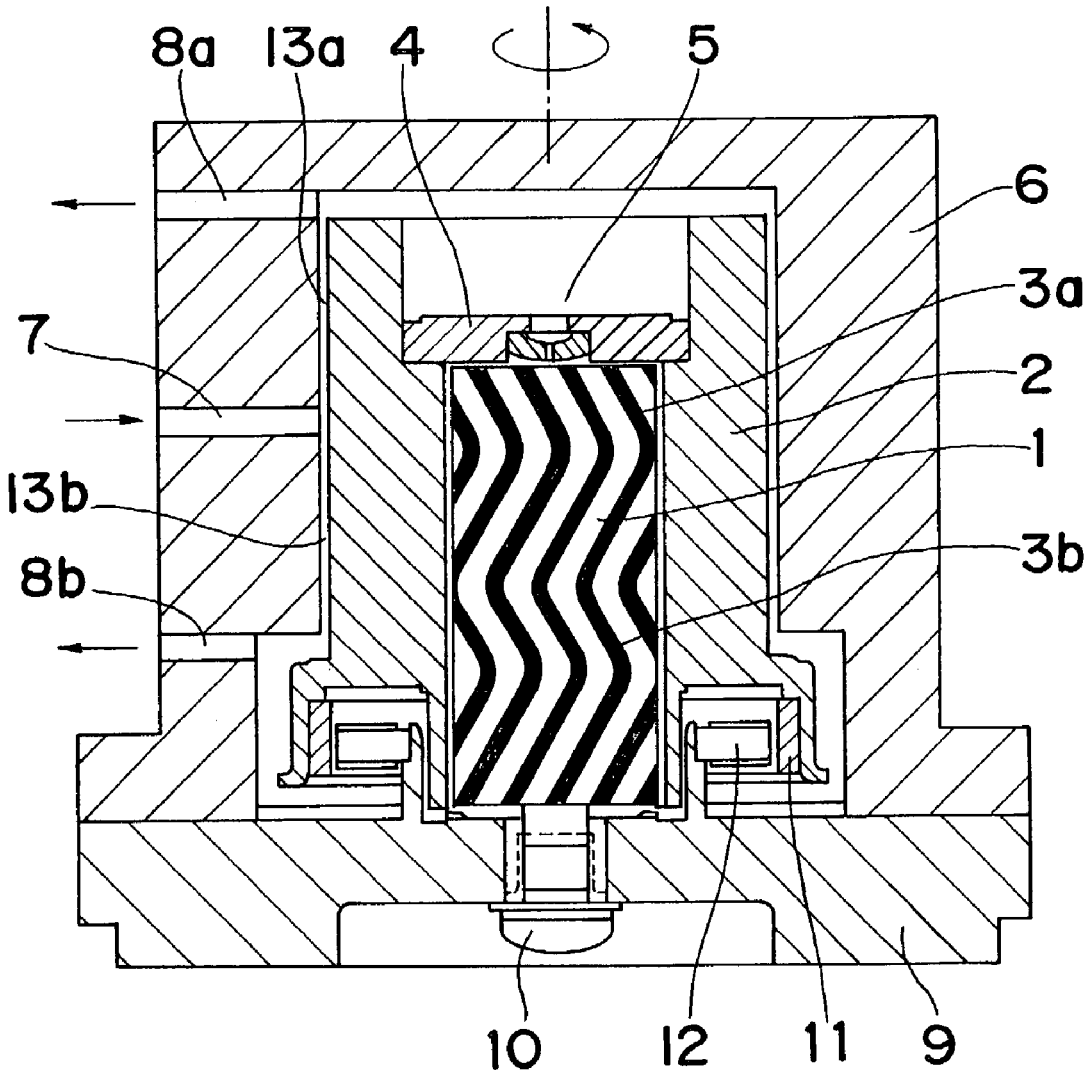
FIG. 3 is a frontal sectional view of a viscosity pump according to a first embodiment of the present invention.
Figure 4:
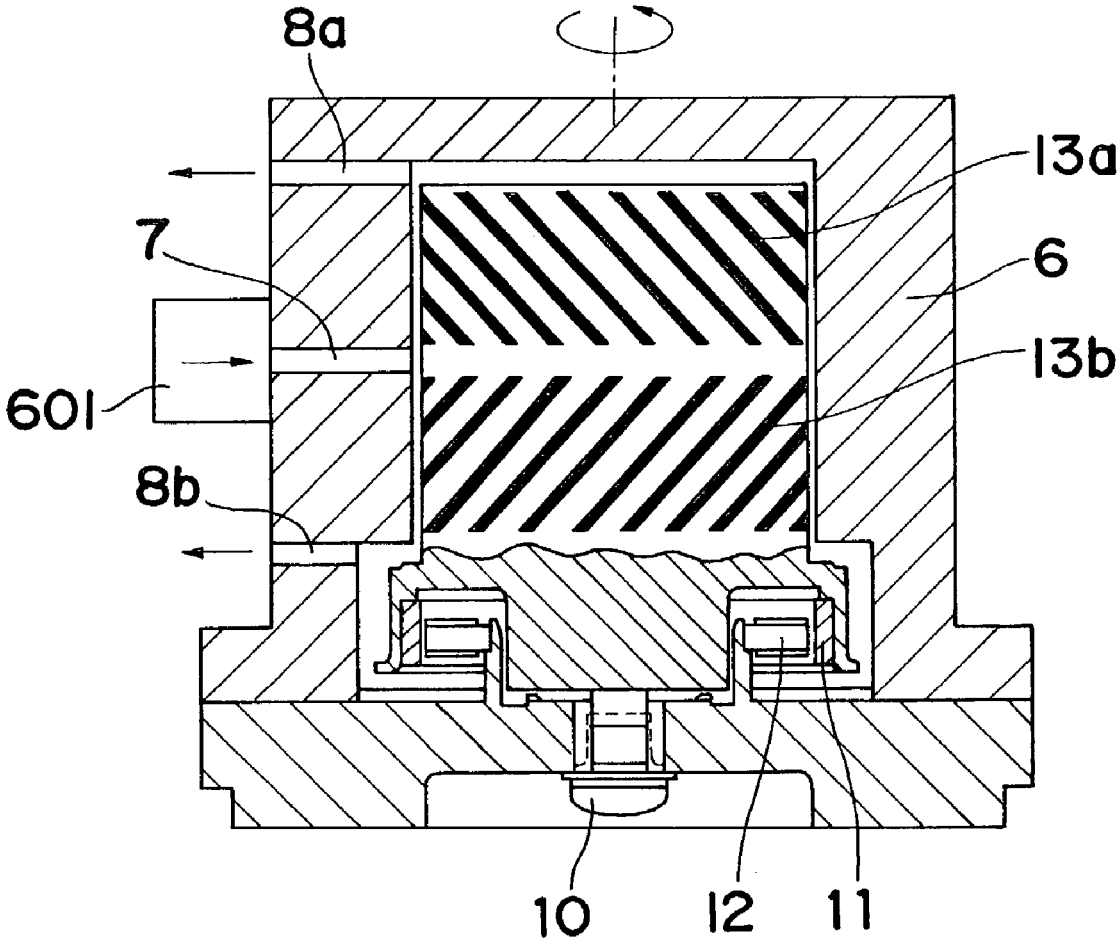
FIG. 4 is a frontal sectional view of the viscosity pump of the first embodiment excluding the pump section.

FIGS. 3 and 4 are frontal sectional views showing the viscosity pump of the first embodiment of the present invention. FIG. 3 is a sectional view of a pump body excluding a bearing portion, and FIG. 4 is a sectional view of the pump body excluding a rotary sleeve (rotor) on which the grooves of the viscosity pump are formed.

FIG. 3 illustrates a stationary shaft 1, a rotary sleeve (rotor) 2, and upper and lower grooves 3*a* and 3*b* of a hydrodynamic gas (air) bearing formed at a relative displacement interface between the stationary shaft 1 and the rotary sleeve 2. FIG. 3 also shows an upper lid 4 integrated with the rotary sleeve 2, a pivot bearing portion 5 provided between an upper end portion of the stationary shaft 1 and the upper lid 4, a housing 6 that houses the rotary sleeve 2, an inlet port 7 formed at the housing 6, an upper outlet port 8*a*, a lower outlet port 8*b*, a lower baseplate 9, a bolt 10 for fixing the stationary shaft 1 to the lower baseplate 9, a motor rotor 11, and a motor stator 12.

FIG. 4 illustrates fluid transport grooves 13*a* and 13*b* formed in an upper portion and a lower portion, respectively, of the relative displacement interface between the outer surface of the rotary sleeve 2 and the inner surface of the housing 6.

Figure 5:
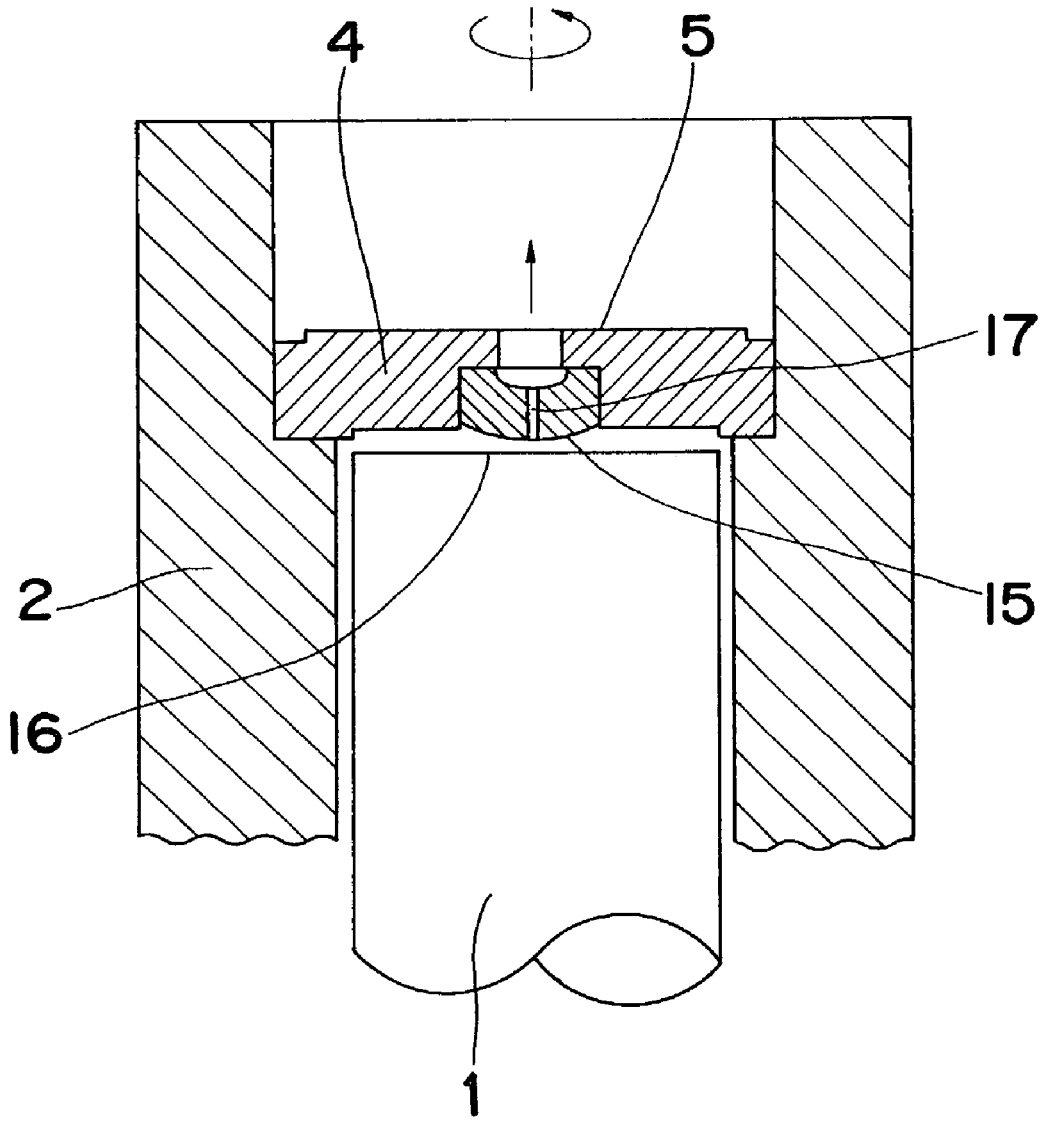
FIG. 5 is an enlarged view of a pivot bearing portion of the viscosity pump of the first embodiment.

FIG. 5 is an enlarged view of the pivot bearing portion 5. This pivot bearing portion 5 is constructed of a spherical surface portion 15 provided on the rotary sleeve 2 side, and a spherical surface support portion 16 provided on the stationary shaft 1 side. An orifice 17 is formed in the vicinity of the center of the spherical surface portion 15. In a stationary state, the rotary sleeve 2 has its axial position retained by the pivot bearing portion 5 arranged above an upper end portion of the stationary shaft 1. When rotation starts, the rotary sleeve 2 has its position promptly regulated in the radial direction by a wedge effect due to the hydrodynamic gas bearing formed on the outer surface of the stationary shaft 1 and the inner surface of the rotary sleeve 2 while keeping a noncontact state.

Moreover, the rotary sleeve 2 is regulated in position in the thrust direction by the following method in the embodiment. As described above, the grooves 3*a*, 3*b* of one pair of hydrodynamic gas bearings formed on the relative displacement surface of the rotary sleeve 2 are asymmetrical in the vertical direction, and the groove sections that exert an upward pumping action are formed to be longer (for example, 10 to 40% longer) than the groove sections that exert a downward pumping action. Therefore, due to an increase in pressure at the upper end portion of the stationary shaft 1, the rotary sleeve 2 is floated in the axial direction. The generated high-pressure air flows out of the orifice 17 to the outside of the bearings. The floating of the rotary sleeve 2 reduces a fluid resistance between the opening portion of the orifice 17 and the spherical surface support portion 16, and this consequently exerts a feedback action to conversely reduce the pressure at the upper end portion of the stationary shaft 1.

By this principle according to which the feedback action is caused, the rotary sleeve 2 retains a constant axial floating position during rotation. It is to be noted that the devices for regulating the positions in both radial and thrust directions provided by the hydrodynamic gas bearings are well-known.

The present embodiment is able to achieve a completely oil-free structure since the noncontact viscosity pump is similarly supported by the noncontact hydrodynamic gas bearings. The hydrodynamic gas bearings, each of which uses air of low viscosity as a lubricating fluid, are therefore unable to obtain a necessary loading capability unless they is rotated at a high speed of normally tens of thousands of revolutions per minute. Therefore, of the hydrodynamic gas bearings uses have been limited to the polygon mirrors of laser beam printers, gyroscopes, and so on.

In the present embodiment, attention is paid to the following points caused by a combination of "a viscosity pump of a micro flow rate and a hydrodynamic gas bearing". That is, (1) The thread groove pump, in which shallow grooves of several tens of micrometers are symmetrically formed, has small fluctuation loads in the radial direction and the axial direction in comparison with those of the pumps of other types. Therefore, the weak point of the hydrodynamic gas bearing, which cannot obtain a large loading capability, does not come to the fore.

(2) The feature of the hydrodynamic gas bearing that can demonstrate an effective loading capability during high-speed rotation and the feature of the viscosity pump that can similarly obtain pressure and flow rate characteristics on a practical level during high-speed rotation coincide with each other.

(3) Both have noncontact rotations.

The aforementioned points (1) and (2) make mutual compensation for the weak points and make the best use of the merit (3) possessed by both of them, consequently materializing a micro pump, which has the features of a completely oil-free simple structure, low vibration, low noise, and so on.

As a device for supporting the rotary member in a noncontact manner without using oil for lubrication, there can be enumerated a hydrostatic gas bearing and an active control type magnetic bearing besides the hydrodynamic gas bearing. The hydrostatic gas bearing, which needs an external pressure source of high-pressure air, is able to be used in a factory that is always equipped with an air source but is hard to use in a consumer commodity. The active control type magnetic bearing, which needs radial and thrust electromagnets and sensors and a controller for normally executing five-axis control, has a drawback in that the bearing is totally increased in size and becomes complicated.

In the present embodiment, transport grooves 13*a* and 13*b* of the viscosity pump (FIG. 4) having different flow directions in the axial direction are formed at the relative displacement interface between the rotary sleeve 2 and the housing 6. The upper transport groove 13*a* and the lower transport groove 13*b* are formed roughly symmetrically to each other, and the opening portion of the inlet port 7 formed at the housing 6 is located intermediately between both the transport grooves 13*a* and 13*b*. The opening portion of the upper outlet port 8*a* formed at the housing 6 is formed in an upper end portion of the rotary sleeve 2, and the opening portion of the lower outlet port 8*b* is formed in the lower end portion (located on the motor side) of the rotary sleeve 2.

In the present embodiment, the shapes and groove depths of the transport groove 13*a* and the transport groove 13*b* as well as the gaps of the relative displacement surface where both the transport grooves are formed are equally formed, and therefore, equal discharge pressures are obtained in the vicinity of both the outlet ports 8*a* and 8*b*. Therefore, thrust loads due to the discharge pressures applied to the upper and lower ends of the rotary sleeve 2 are canceled.

As a result, only a very small thrust load is applied to the thrust support portions of the stationary shaft 1 and the rotary sleeve 2, and therefore, thrust support at the pivot bearing portion 5 in accordance with the aforementioned principle becomes easy. As a result, the present rotary unit, in which the viscosity pump is supported on the hydrodynamic bearing, becomes able to completely achieve noncontact super-high-speed rotation.

If there are some differences in the shapes and the groove depths between the upper transport groove 13*a* and the lower transport groove 13*b* or even when the influence of the aforementioned high-pressure air flowing out of the pivot bearing portion 5 is exerted, the pressures at the upper and lower ends of the rotary sleeve 2 become equal to each other if the downstream sides of the upper outlet port 8*a* and the lower outlet port 8*b* are connected with each other.

It is herein supposed the case where the radial groove of the viscosity pump is formed only in one direction. Assuming that the radius R of the thread groove pump is 15 mm and a pressure difference $\Delta P$ of 0.5 kg/cm$^2$ (0.05 MPa) is generated on the suction side and the discharge side, then the thrust load f becomes 3.5 kgf (34.6 N).

It is normally difficult to support the thrust load f only by the hydrodynamic effect of the air of low viscosity. Although the bearable thrust load can be increased if a slide bearing with oil lubrication or grease lubrication is used, the bearing is hard to use in the pumps for use in the fields of foods, pharmaceuticals, medical treatment, healthcare equipment, and so on of the objects of the present embodiment.

Devising the positional relations between the inlet port 7 and the outlet ports 8*a* and 8*b* have also been important in forming the ports 7, 8*a*, 8*b*.

It is possible to invert the positions of the inlet port and the outlet port in the present embodiment if only the function of the viscosity pump is considered. However, in the structure of the present embodiment in which the hydrodynamic gas bearing and the viscosity pump are combined with each other, if the suction side of the viscosity pump is located at the boundary portion of the hydrodynamic gas bearing, then this boundary portion comes to have a negative pressure (below the atmospheric pressure), disadvantageously degrading the performance of the hydrodynamic gas bearing. Depending on the level of the negative pressure, the bearing becomes inoperative. In the present embodiment, the space located on the discharge side of the viscosity pump where the motor is arranged (in the vicinity of the lower outlet port 8*b*) is connected with the lubricating portion of the hydrodynamic gas bearing.

Since the discharge side communicates with the atmosphere and the pressure thereof is roughly equal to the atmospheric pressure, there is no hindrance to the performance of the hydrodynamic bearing. That is, the aforementioned devising for enabling the combination of the noncontact viscosity pump and the similarly noncontact hydrodynamic gas bearing allows the materialization of a completely oil-free pump that replaces the diaphragm type.

Furthermore, in the aforementioned embodiment, the same gas is used as the gas which is transported by the pump and the gas which used for lubricating the bearing. That is, in FIGS. 3 and 4, the pump chamber, in which the fluid transport grooves 13*a* and 13*b* of the viscosity pump are formed, is connected with the space in which the upper groove 3*a* and the lower groove 3*b* of the hydrodynamic gas bearing are formed, in terms of fluid path. This point becomes extremely advantageous in maintaining a constant oxygen concentration when the pump of the aforementioned embodiment is used as, for example, a reduced pressure pump for an oxygen enriching apparatus. The above is because, if the lubricating portion of the hydrodynamic gas bearing is externally supplied with air, the special oxygen-enriched air is disadvantageously diluted.

Consideration will be given below as to what influence the various parameters constituting the viscosity pump of the present embodiment exert on the characteristic (hereinafter referred to as a "PQ characteristic") of a flow rate Q with respect to the pressure difference ΔP of the viscosity pump.

Figure 6:
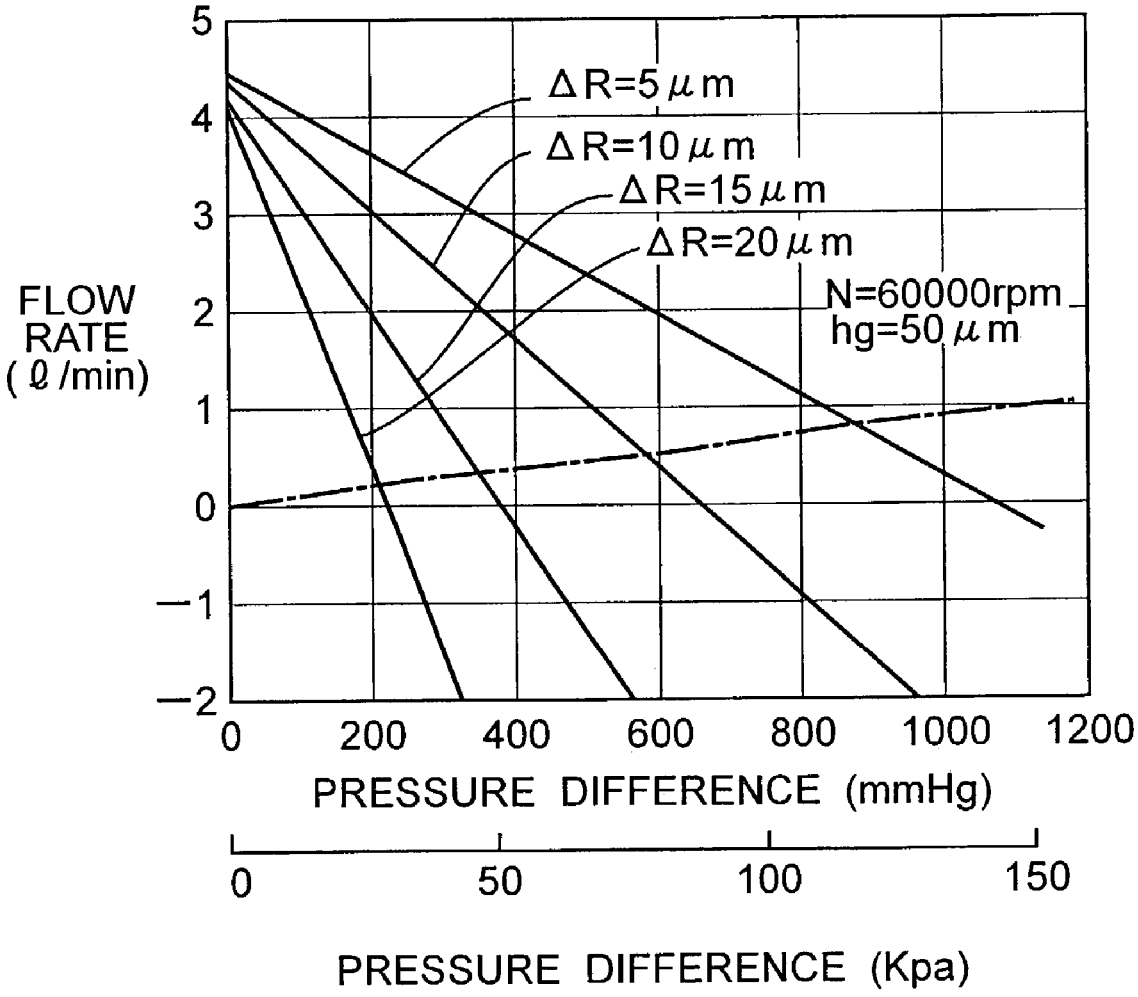
FIG. 6 is a graph showing the relation between a PQ characteristic and a gap of the pump according to analytical results of the first embodiment.
Figure 7:
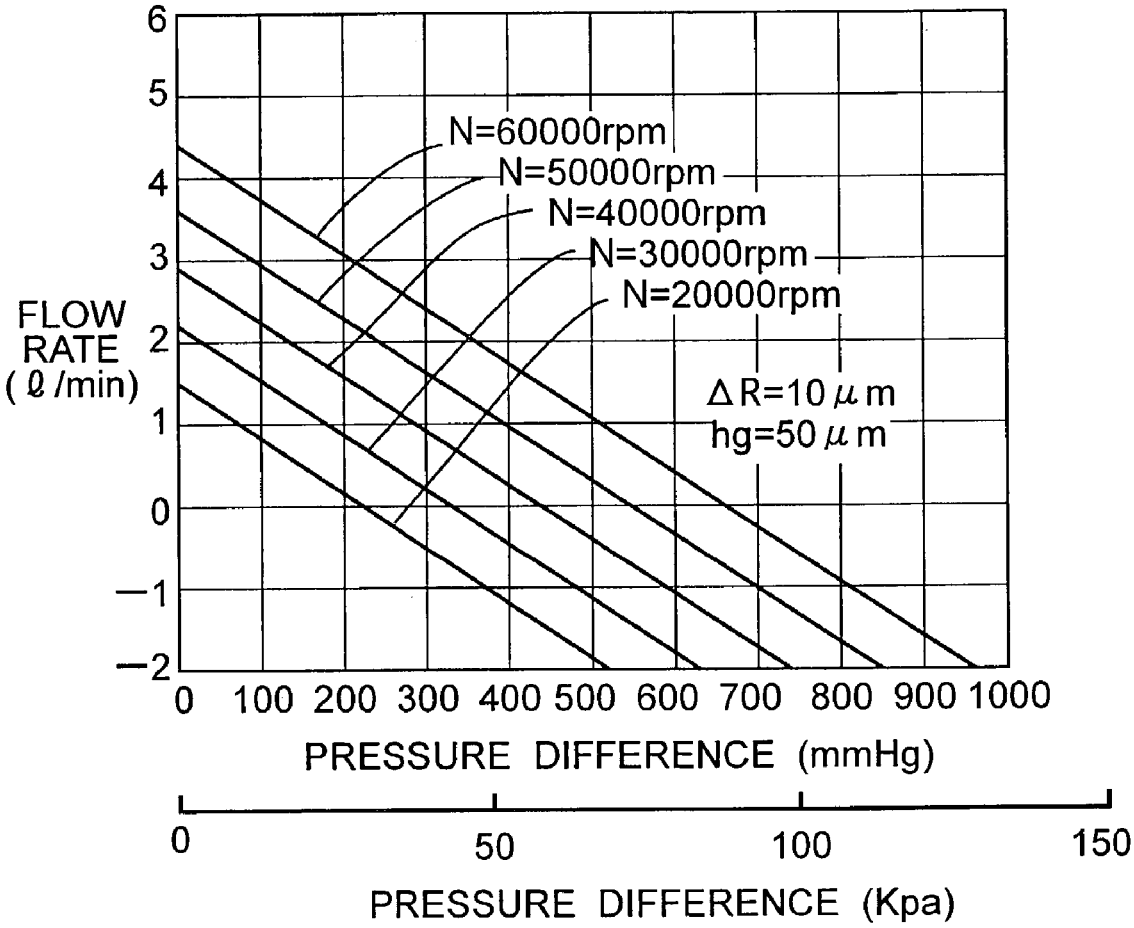
FIG. 7 is a graph showing the relation between the PQ characteristic and the number of revolutions of the pump according to the analytical results of the first embodiment.
Figure 8:
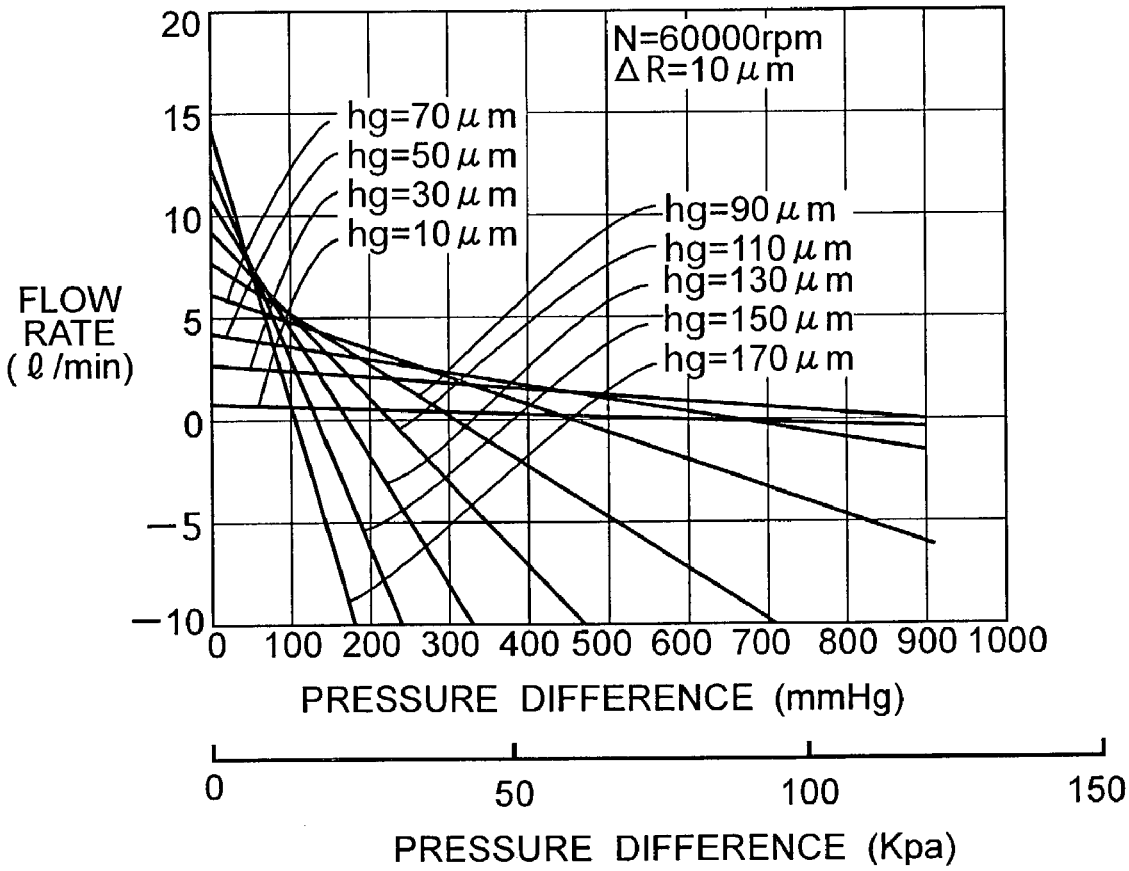
FIG. 8 is a graph showing the relation between the PQ characteristic and the groove depth of the pump according to the analytical results of the first embodiment.

FIGS. 6 through 8 show analytical results of the PQ characteristic of the viscosity pump obtained under the conditions of Table 1. In this case, the pressure difference means a difference ΔP of Pd−Ps between a discharge side pressure Pd (atmospheric pressure) and a suction side pressure Ps.

FIG. 6 shows the influence of the radial gap ΔR of the thread groove pump exerted on the PQ characteristic. The one-dot chain line in FIG. 6 indicates the load resistance (for example, an air resistance when air passes through the oxygen enriching membrane on the suction side) of the vacuum pump, and the intersecting point of this load resistance curve and the PQ characteristic becomes the operating point of the pump. For example, if the radial gap ΔR is set at 10 μm, then a flow rate Q of 0.5 l/min (8.3 cc/sec) is obtained under the condition of a pressure difference ΔP of 600 mmHg (0.79 kg/cm$^2$).

If the pressure difference ΔP approaches zero, i.e., if the load of the vacuum pump is gradually reduced to no load, then the flow rate converges on a constant value, i.e., a maximum flow rate value $Q_{MAX}$ of the pump (value of Q when ΔP approaches zero) regardless of the size of the radial gap ΔR. When a load is applied to the pump, the greater flow rate is obtained with the greater ultimate vacuum pressure $\Delta P_{MAX}$ (value of ΔP when Q=0) of the pump. If the radial gap ΔR increases, then the ultimate vacuum pressure $\Delta P_{MAX}$ of the pump reduces. According to the examination results of the embodiment, it is proper to set the radial gap ΔR so that ΔR≦15 μm in order to make this pump applicable to various uses.

FIG. 7 shows the influence of the number N of revolutions of the thread groove pump exerted on the PQ characteristic. The number of revolutions is proportional to both the maximum flow rate value $Q_{MAX}$ and the ultimate vacuum pressure $\Delta P_{MAX}$ of the pump. In the case of the present embodiment, the pump becomes applicable to various uses when the number N of revolutions of the pump is set so that N≧20000 rpm.

FIG. 8 shows the influence of the depth of a transport groove hg of the thread groove pump exerted on the PQ characteristic. If the groove depth hg is gradually increased from the neighborhood of zero, then both the flow rate maximum value $Q_{MAX}$ and the ultimate vacuum pressure $\Delta P_{MAX}$ increase. However, if the groove depth exceeds a certain value, then the ultimate vacuum pressure $\Delta P_{MAX}$ significantly reduces more than the increase of $Q_{MAX}$. According to the examination results of the present embodiment, the present pump is able to be applicable to various uses when the groove depth hg is set so that hg≦150 μm.

TABLE 1

| Parameter | Symbol | Designed Value |
|---|---|---|
| Thread Groove Angle | α | 15° |
| Gap of Thread Groove Pump | ΔR | FIGS. 6–8 |
| Ridge Width | br | 0.5 mm |
| Groove Width | bg | 1.0 mm |
| Outside Diameter of Thread Groove Pump | D | 30 mm |
| Number of Revolutions | N | FIGS. 6–8 |
| Transport Groove Depth | hg | FIGS. 6–8 |
| Thread Groove Length | B | 13 × 2 mm |

Table 2 shows comparisons of the embodiment of the present invention constructed under the conditions of Table 1 with respect to the dimensions, weight, and so on of the conventional diaphragm type pump. The comparative diaphragm type pump obtains roughly the same amount of exhaust flow rate and pressure as those of the embodiment of the present invention.

TABLE 2

| | Diaphragm Type | Embodiment |
|---|---|---|
| Completely Oil Free | ○ | 602 |
| Dimension (Occupancy Volume) | 1 | 1/8 compared to 1 |
| Weight | 1 | 1/4 compared to 1 |
| Vibration and Noise | x | ○ |
| Operating Life | 3000 H | No Factor of Deterioration |

Figure 9:
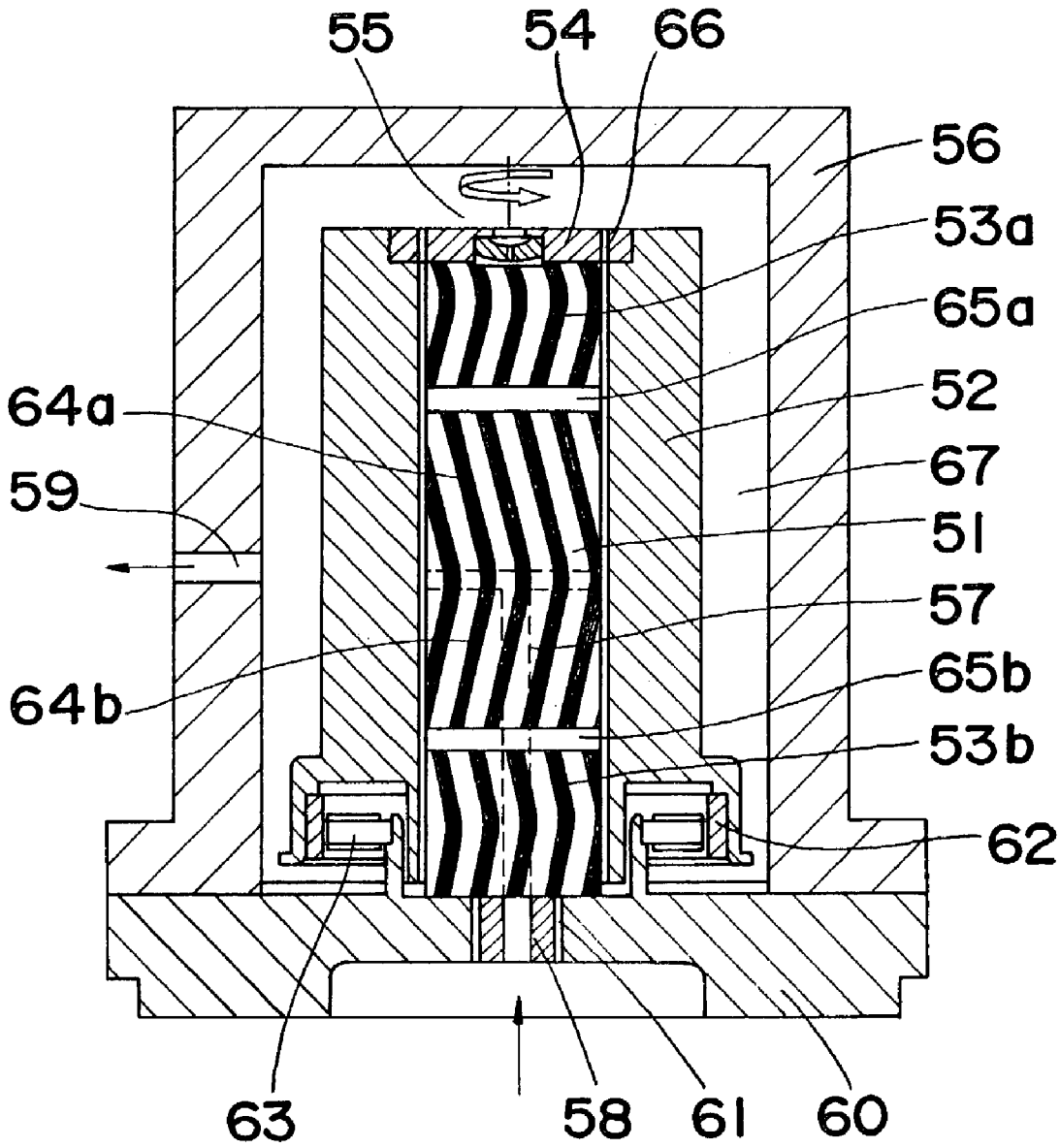
FIG. 9 is a frontal sectional view of a viscosity pump according to a second embodiment of the present invention.

FIG. 9 is a frontal sectional view showing the viscosity pump of the second embodiment of the present invention, where a transport groove for exerting a pumping action on fluid and a hydrodynamic groove which is necessary for constituting the hydrodynamic gas bearing are formed at an identical relative displacement interface between a rotor (rotary sleeve) and a housing.

FIG. 9 illustrates a stationary shaft 51, a rotary sleeve (rotor) 52, and hydrodynamic gas bearing grooves 53*a* and 53*b* formed at the relative displacement interface between the stationary shaft 51 and the rotary sleeve 52. FIG. 9 also shows an upper lid 54 integrated with the rotary sleeve 52, a pivot bearing portion 55 provided between an upper end portion of the stationary shaft 51 and the upper lid 54, a housing 56 that houses the rotary sleeve 52, a suction passage 57 (indicated by the chain lines) formed penetratively through the stationary shaft 51, an inlet port 58 that is the opening portion of the suction passage formed in the lower end portion of the stationary shaft 51, an outlet port 59 formed at the housing 56, a lower baseplate 60, a stationary shaft threaded portion 61 for fixing the stationary shaft 51 to the lower baseplate 60, a motor rotor 62, and a motor stator 63. The reference numerals 64*a* and 64*b* denote fluid transport grooves formed at the relative displacement interface between the stationary shaft 51 and the rotary sleeve 52. The reference numerals 65*a* and 65*b* denote an upper boundary portion and a lower boundary portion, respectively, between the pump portion and the bearing portion.

The fluid is sucked from outside the pump via the suction passage 57 formed at the stationary shaft 51 by the pumping action of the transport grooves formed at the relative displacement interface between the stationary shaft 51 and the rotary sleeve 52. The groove configurations of the pair of transport grooves 64*a* and 64*b* are symmetrical to each other and have different directions of the pumping action. Therefore, the sucked fluid vertically diverges at an opening portion of the suction passage 57 equally and flows into the grooves 53*a* and 53*b* of the hydrodynamic gas bearing via the boundary portions 65*a* and 65*b*, respectively.

Further, the fluid, which has passed through the gap of the bearing, flows into a discharge chamber 67 from an opening portion 66 formed at the upper lid 54 in a route and via a space between the motor rotor 62 and the stator 63 in another route. In the present embodiment, a gap $\Delta R_B$ between the boundary portions 65*a* and 65*b* of the pump portion and the bearing portion is 0.3 to 0.5 mm and is formed sufficiently larger than any of the gaps of the other portions (pump portion and bearing portion) in order to smooth the pressure pulsation of the fluid to be discharged.

A wedge pressure, which gives rigidity to the hydrodynamic gas bearing, has no relation to the absolute pressure value at the boundary portions. Accordingly, there is no hindrance to the bearing performance even if the hydrodynamic gas bearing is arranged on the discharge side of the pump. Moreover, in the present embodiment, the pump portion and the bearing portion are formed by utilizing the identical relative displacement interface between the stationary shaft 51 and the rotary sleeve 52. Therefore, it is easy to obtain processing accuracies of the members, and the construction becomes further simplified.

Figure 10:
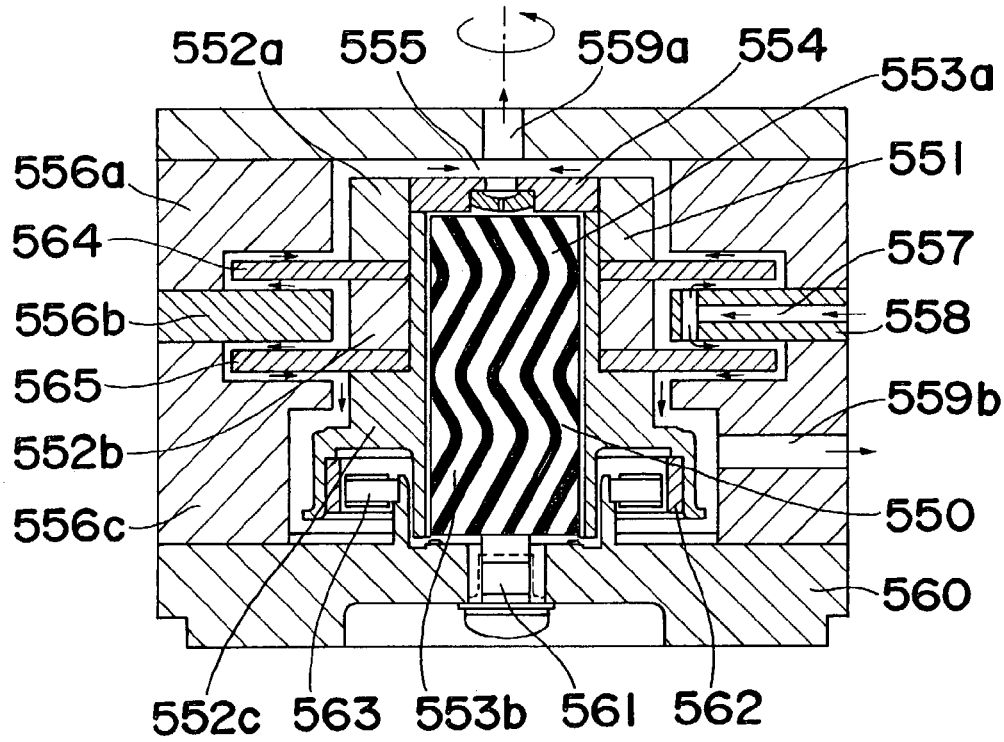
FIG. 10 is a frontal sectional view of a viscosity pump according to a third embodiment of the present invention.

FIG. 10 is a frontal sectional view showing the viscosity pump of the third embodiment of the present invention, where a transport groove for exerting a pumping action to fluid is formed on a thrust surface. In FIG. 10, there is a construction of a stationary shaft 550, a rotary sleeve (rotor) 551, and members 552*a*, 552*b*, and 552*c*. FIG. 10 shows hydrodynamic gas bearing grooves 553*a* and 553*b* formed at the relative displacement interface between the stationary shaft 550 and the rotary sleeve 551. FIG. 10 also shows an upper lid 554 integrated with the rotary sleeve 551, a pivot bearing portion 555 provided between an upper end portion of the stationary shaft 550 and the upper lid 554, housings 556*a*, 556*b*, and 556*c* that house the rotary sleeve 551, a suction passage 557 formed penetratively through the housing 556*b*, an inlet port 558 of the suction passage, upper and lower outlet ports 559*a* and 559*b*, a lower baseplate 560, a stationary shaft threaded portion 561 for fixing the stationary shaft 550 to the lower baseplate 560, a motor rotor 562, and a motor stator 563.

Figure 11:
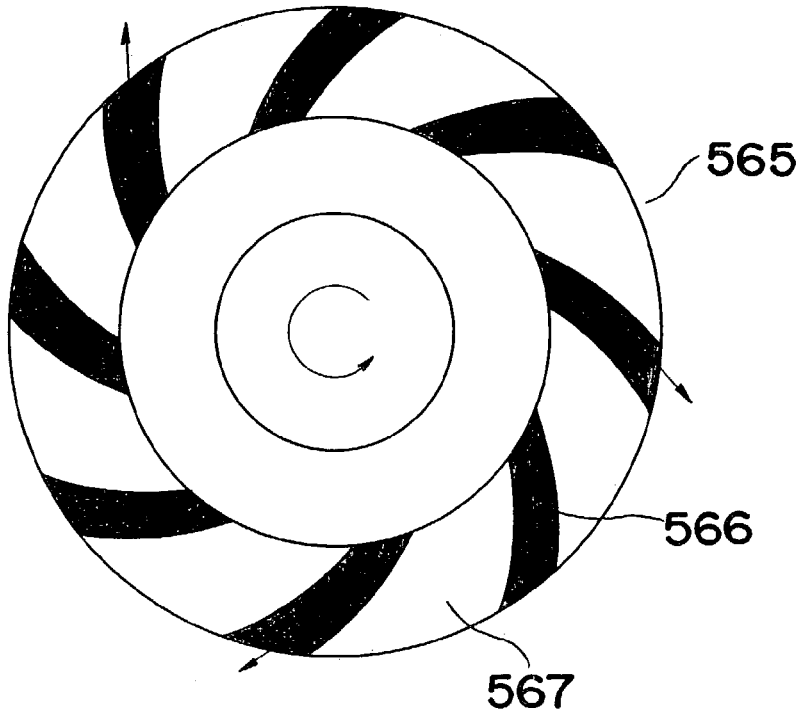
FIG. 11 is a top view of a thrust (thin) disk of the third embodiment in a thrust direction of the rotor.

The reference numerals 564 and 565 denote upper and lower thrust disks (thin disks) mounted on the rotary sleeve 551. A fluid transport groove as shown in FIG. 11 is formed at each of the relative displacement interfaces between the upper thrust disk 564 and the housing 556*a* and between the upper thrust disk 564 and the housing 556*b*. A fluid transport groove is similarly formed at each of the relative displacement interfaces between the lower thrust disk 565 and the housing 556*b* and between the lower thrust disk 565 and the housing 556*c*.

FIG. 11 is a top view of the lower thrust disk 565 viewed from above, showing a groove portion (groove) 566 colored by black and a ridge portion (ridge) 567.

Figure 12:
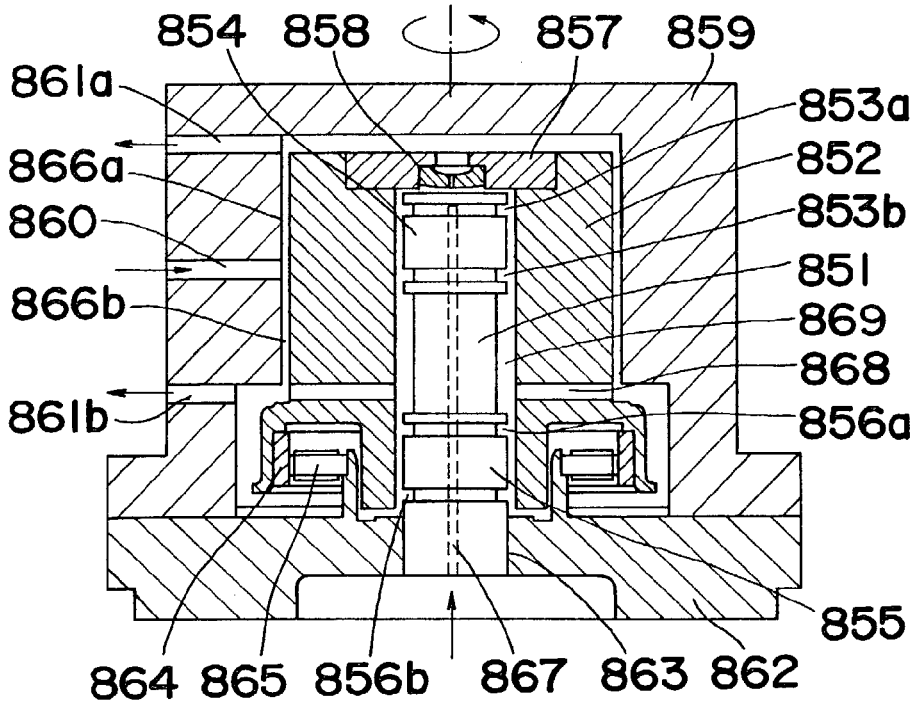
FIG. 12 is a frontal sectional view of a viscosity pump according to a fourth embodiment of the present invention.

FIG. 12 is a frontal sectional view showing the viscosity pump of the fourth embodiment of the present invention, where a hydrostatic gas bearing utilizing an external pressure source is employed instead of the hydrodynamic gas bearing in order to support the rotor rotating at high speed. Also, in the present embodiment, a completely oil-free pump, which does not use the machine oil at all, can be materialized.

FIG. 12 illustrates a stationary shaft 851, a rotary sleeve (rotor) 852, and circumferential grooves 853*a* and 853*b* that constitute an upper hydrostatic gas bearing 854 formed at the upper relative displacement interface between the stationary shaft 851 and the rotary sleeve 852.

In order to similarly constitute a lower hydrostatic gas bearing 855, circumferential grooves 856*a* and 856*b* are formed at the lower relative displacement interface between the stationary shaft 851 and the rotary sleeve 852. FIG. 12 also shows an upper lid 857 integrated with the rotary sleeve 852, a pivot bearing portion 858 provided between an upper end portion of the stationary shaft 851 and the upper lid 857, a housing 859 that houses the rotary sleeve 852, an inlet port 860 formed at the housing 859, outlet ports 861*a* and 861*b* formed at the housing 859, a lower baseplate 862, a portion 863 for connecting the stationary shaft 851 to the lower baseplate 862, a motor rotor 864, and a motor stator 865.

Fluid transport grooves 866*a* and 866*b* are formed at the relative displacement interface between the outer surface of the rotary sleeve 852 and the inner surface of the housing 859 similar to the transport grooves 13*a* and 13*b* in FIG. 4 of the first embodiment. There is a supply source side air passage 867 (indicated by the chain lines) of the hydrostatic gas bearing formed penetratively through the stationary shaft 851. From this air passage, high-pressure air is supplied to the circumferential grooves 853*a*, 853*b*, 856*a*, and 856*b* via an orifice formed in the radial direction of the stationary shaft 851.

If the hydrostatic gas bearing is supplied with oxygen-enriched gas when the present embodiment is applied to an oxygen enriching apparatus, the oxygen concentration is not required to be reduced. There is a relief passage 868 for maintaining constant the pressure of an intermediate portion 869 of the upper and lower hydrostatic gas bearings.

The thrust supporting method of the present embodiment utilizes the supply source pressure of the hydrostatic gas bearing instead of using the pumping pressure of the hydrodynamic groove, and the principle of floating at the pivot bearing portion 858 is similar to that of the aforementioned embodiment.

Figure 13:
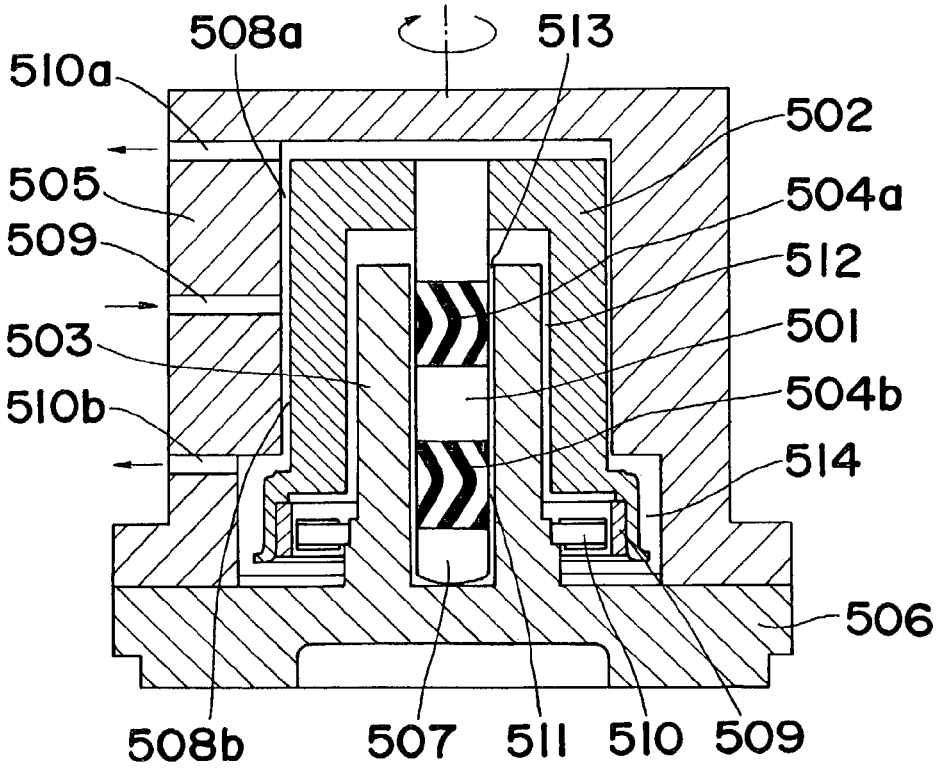
FIG. 13 is a frontal sectional view of a viscosity pump according to a fifth embodiment of the present invention.

FIG. 13 is a sectional view showing the viscosity pump of the fifth embodiment of the present invention. This embodiment is one example that permits the use of some quantity of oil for bearing lubrication (aforementioned item [2]) in correspondence with the completely oil-free structure of the first and second embodiments. In order to support the rotor that is rotating at a high speed, a hydrodynamic oil bearing is used instead of the hydrodynamic gas bearing. Although the bearing to be used for the pump of the present embodiment is allowed to be the general ball bearing, it is possible to further increase the speed by employing a hydrodynamic fluid bearing (including the hydrodynamic gas bearing and the hydrodynamic oil bearing). The pump of the present embodiment can be applied to, for example, an air conditioning machine, an air conditioner, and a high-efficiency combustor by combining the pump with an oxygen enriching membrane module.

FIG. 13 illustrates a rotary shaft 501, a rotary sleeve (rotor) 502, a stationary sleeve 503 that houses the rotary shaft 501, and hydrodynamic oil bearing grooves 504*a* and 504*b* formed at the relative displacement interface between the rotary shaft 501 and the stationary sleeve 503. FIG. 13 also shows a housing 505 that houses the rotary sleeve 502, a lower baseplate 506 integrated with the stationary sleeve 503, and a pivot bearing portion 507 formed at the relative displacement interface between the lower end portion of the rotary shaft 501 and the lower baseplate 506. Fluid transport grooves 508*a* and 508*b* are formed at the relative displacement interface between the outer surface of the rotary sleeve 502 and the inner surface of the housing 505 similar to the transport grooves 13*a* and 13*b* in FIG. 4 of the first embodiment. It is to be noted that the angle of the transport grooves differ by 180 degrees since the direction of rotation differs from that of the first embodiment.

The reference numeral 509 denotes an inlet port formed at the housing 505 in a portion located intermediate between the transport grooves 508*a* and 508*b*. The reference numerals 510*a* and 510*b* denote upper and lower outlet ports formed at the housing 505 in portions located at the upper and lower ends of the rotary sleeve 502. FIG. 13 also shows a motor rotor 509 and a motor stator 510.

In the present embodiment, oil for lubrication is enclosed in a gap portion 511 located between the outer surface of the rotary shaft 501 and the inner surface of the stationary sleeve 503. The reference numeral 512 denotes a gap portion located between the outer surface of the stationary sleeve 503 and the inner surface of the rotary sleeve 502. FIG. 13 also shows an upper opening portion 513 of the stationary sleeve 503 and a discharge space 514 connected to the lower outlet port 510*b*. A long gap portion 512 provided between the upper opening portion 513 and the discharge space 514 has the effect of preventing the leak of oil.

If a viscos seal (thread groove seal), which feeds the fluid with small pressure to the bearing side, is formed at the relative displacement interface between the stationary sleeve 503 and the rotary sleeve 502 by utilizing this gap portion 512, the effect of preventing the leak of oil can be made more complete.

The pump structure of the aforementioned embodiment is provided with the bearing in the portion located inside the rotary sleeve where the groove of the viscosity pump is formed. Therefore, sufficient rigidity can be secured with respect to a fluctuating load and the like because of a radial load and moment applied to the rotary sleeve (rotor), e.g., an unbalanced load due to an unbalanced mass, a fluctuation load due to pressure fluctuation of the viscosity pump section, and so on.

Figure 14:
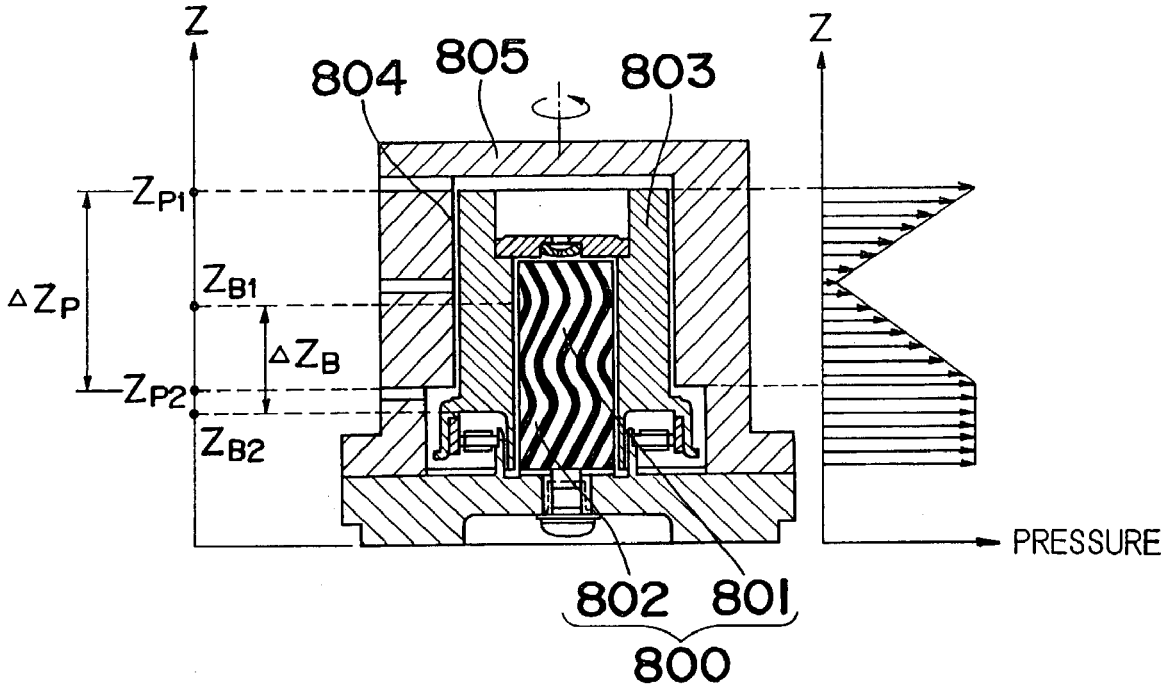
FIG. 14 is a model diagram of the embodiment of the present invention.

Giving explanation with reference to the model diagram of FIG. 14, there are shown a shaft 800, an upper bearing 801, a lower bearing 802, a rotary sleeve 803, and a fluid transport groove 804 formed at the relative displacement interface between the rotary sleeve 803 and the housing 805 of the opposite surface.

It is assumed herein that a height in a z-direction of an intermediate portion of the upper bearing 801 is $Z_{B1}$, a height in the z-direction of an intermediate portion of the lower bearing 802 is $Z_{B2}$. It is further assumed that if a height in the z-direction of an upper end portion of the transport groove 804 is $Z_{P1}$, and a height in the z-direction of a lower end portion is $Z_{P2}$, then an interval in which the transport groove 804 is formed satisfies $Z_{P2} \leqq z \leqq Z_{P1}$.

In the course of developing the present invention for materialization, evaluations were made by changing the method of arranging the bearing and the rotary sleeve in various ways. As a result, the rotary sleeve was able to be supported with sufficient rigidity with respect to the fluctuating load and high-speed rotation was able to be achieved with high deflection accuracy if there was a construction such that the interval $Z_{B2} \leqq z \leqq Z_{B1}$ between the upper and lower bearings supporting the rotating member overlap with the interval $Z_{P2} \leqq Z \leqq Z_{P1}$ in which the transport groove is formed.

A gap ΔR to be set for the obtainment of an exhaustion performance (flow rate characteristic with respect to pressure) required by the thread groove pump of the first through fifth embodiments has an extremely narrow dimension of 5 to 15 μm as shown by, for example, one example in FIG. 6. If dust, which has an outside diameter not smaller than the aforementioned dimension ΔR exists in the atmosphere when air is sucked from the atmosphere, the dust intrudes into the gap of the fluid transport path and causes the problems of locking, seizing, and the like. This point is a weak point of the viscosity pump in comparison with the pumps of other types. If a dust filter for preventing the intrusion of particles having a diameter of not smaller than a prescribed particle diameter into the pump is arranged on the upstream side of the pump connected to the inlet port, then the aforementioned problem can be eliminated.

Attention is now paid to the fact that the oxygen enriching membrane concurrently has the function of the aforementioned dust filter when the present invention is applied to a reduced pressure pump of a fluid transport system for enriching oxygen in the air by using a polymer gas separation membrane (oxygen enriching membrane).

For example, in the case of the oxygen enriching module of the flat membrane type, the nonporous support membrane as a communicating foam has a filter function of 0.1 μm. That is, the innate weakness of the viscosity pump being susceptible to dust poses no practical issue in the fluid transport system of the present invention. That is, a synergistic effect produced by the combination of "the gas separation membrane (oxygen enriching membrane) and the viscosity pump of the present invention" materializes a system that has the features of low vibration, low noise, long operating life, oil free, simple construction, and so on without being susceptible to the following weak points of the conventional viscosity pump to the fore, the weak points being:

(1) poor at large displacement;

(2) susceptible to dust; and so on

Each of the embodiments described above has the structure of sucking the fluid from the common portion where the two transport grooves are adjacently located, making the fluid diverge and discharging the fluid via the respective transport grooves. This method maintains the boundary portions of the bearing portions consistently at the atmospheric pressure in the embodiments, and therefore, the bearing performance does not become degraded when, for example, the air bearing is employed.

However, when the required vacuum pressure is not required to be suppressed low, a construction inverse to this is also acceptable. That is, inlet ports are individually formed in portions where the two transport grooves are located farthest apart from each other, and an outlet port is formed in a common portion where the transport grooves are adjacently located. Giving explanation with reference to FIG. 3 of the first embodiment, reference numerals 8*a* and 8*b* may denote inlet ports and reference numeral 7 may denote an outlet port. In this case, the boundary portion of the bearing portions and the space in which the motor rotor 11 and the motor stator 12 are housed come to have negative pressures. Although the loading capability of the air bearing is reduced, a viscosity loss (consumption power) caused by high-speed rotation in the atmosphere can be conversely reduced. If two or a plurality of transport grooves are symmetrically formed and the plurality of inlet ports are similarly connected together outside, then the pressures at the upper and lower ends of the rotor (rotary sleeve 2) become equal to each other, and no thrust load due to a pressure difference is generated.

In the embodiments except for the second embodiment, the transport groove is formed on the outer peripheral side of the rotor, and the groove of the hydrodynamic bearing is formed on the inner peripheral side. However, a construction inverse to this construction is acceptable. That is, the hydrodynamic groove is formed on the outer peripheral side of the rotor, and the transport groove is formed on the inner peripheral side.

Otherwise, the second embodiment may be developed to provide a construction in which the transport groove and the hydrodynamic groove are shared. That is, the transport groove concurrently has the function of the hydrodynamic bearing for stably supporting the rotation of the rotor concurrently with the operation of transporting the fluid in the axial direction. In this case, there may be provided, for example, a construction in which one pair of asymmetrical grooves are vertically arranged and the fluid flows upward from the lower end portion of the rotor.

Figure 15:
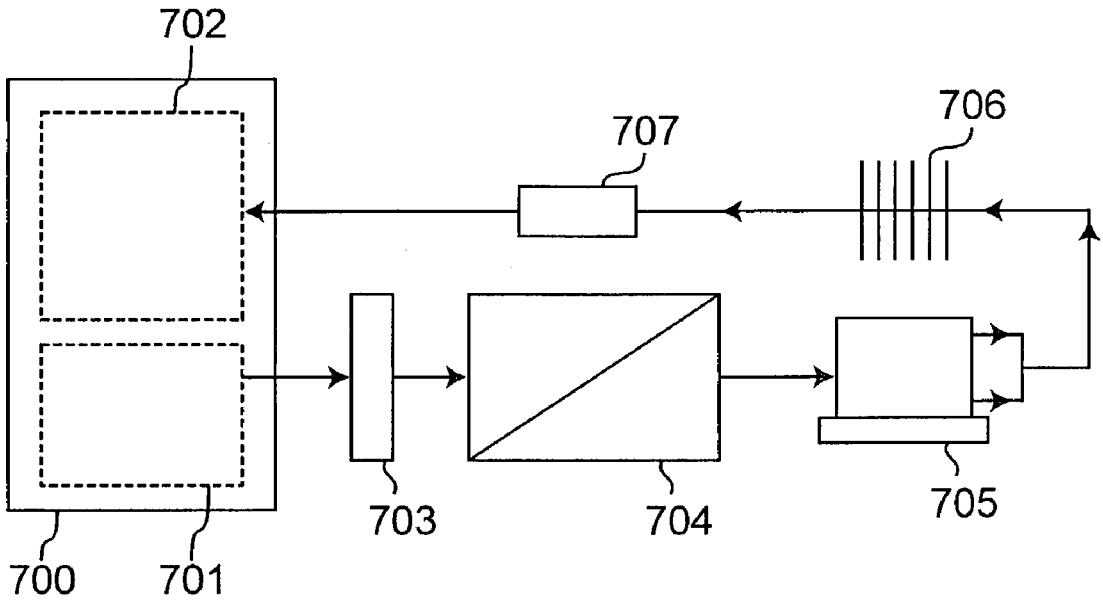
FIG. 15 is a view showing one example of a nitrogen enriching system with the built-in pump of the present invention.
Figure 16:
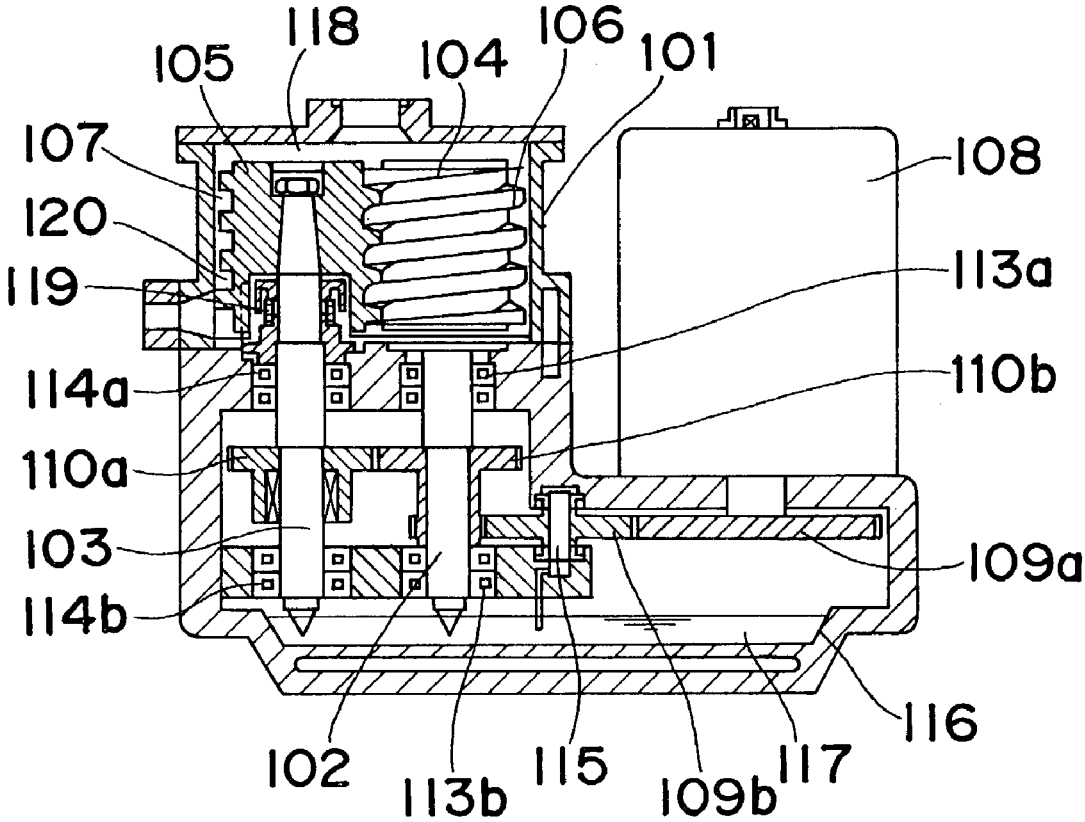
FIG. 16 is a view showing a prior art thread groove type dry pump.
Figure 17:
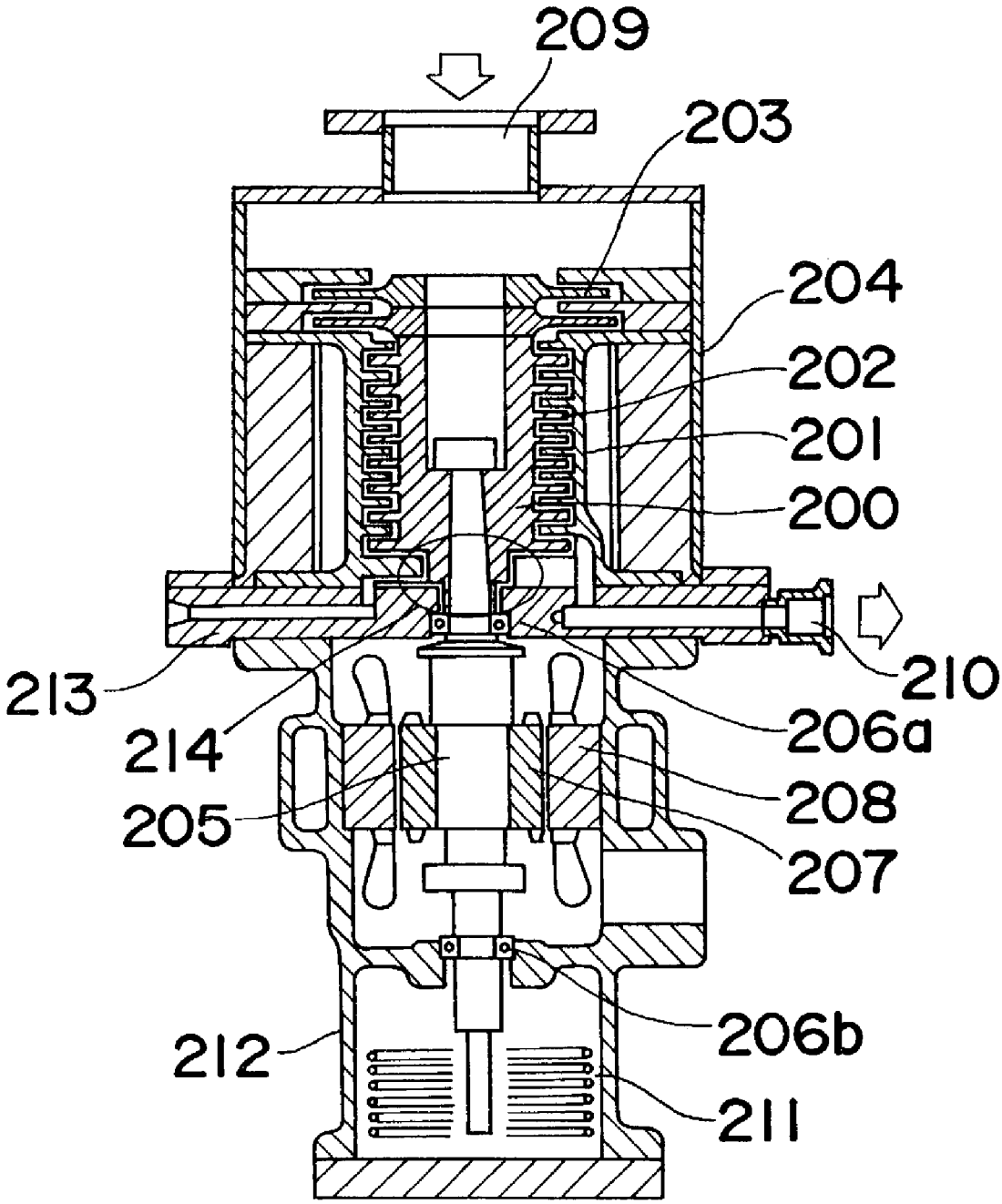
FIG. 17 is a view showing a prior art centrifugal dry pump.
Figure 18:
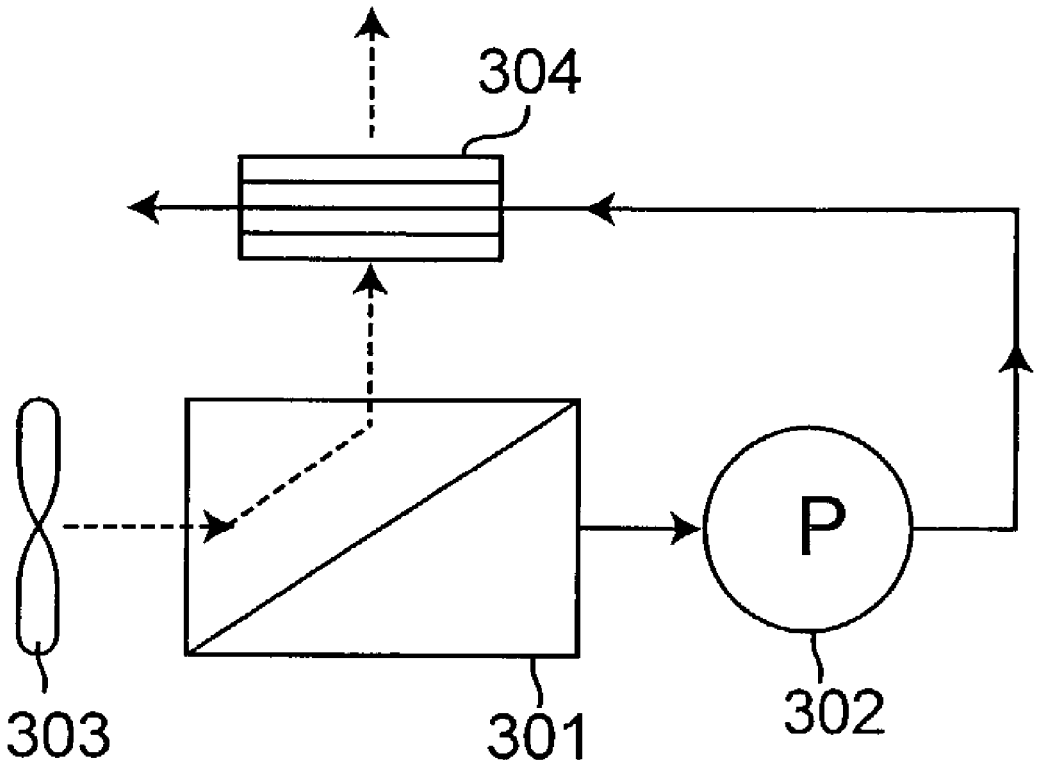
Fig.18 PRIOR ART
FIG. 18 is a view showing the construction of a prior art oxygen enriching system.

FIG. 15 shows the application of the pump and the fluid transport system of the embodiment of the present invention to a system in which a nitrogen-enriched space for preventing the oxidation of foods is formed in a refrigerator by utilizing the principle of the oxygen enriching membrane. FIG. 15 illustrates a refrigerator main body (nitrogen enriching space) 700, a chilling room 701 for storing vegetable, fruits, and the like, another refrigeration room 702, an air blower fan 703, an oxygen enriching membrane module 704, a reduced pressure pump (vacuum pump) 705, a heat sink (radiating fins) 706, and a dehumidifying device 707. The members 700 through 707 constitute the pump and fluid transport system of the object to which the present invention is applied. In the aforementioned embodiment, it is possible to preserve foods for a long time by extracting oxygen $O_2$ from the chilling room 701 that is a hermetic space, for the provision of a nitrogen-enrich space.

In comparison with other electrical appliances, the refrigerator is required to have, in particular, quietness and a long operating life. When the pump of the present invention is applied to the refrigerator as described above, there are the following advantages.

(1) The features of low vibration and low noise peculiar to the viscosity pump can be exploited.

(2) There is neither mechanical sliding portions nor fatigable portions, and there is no portion that restricts the operating life.

(3) Since the space of the object to be nitrogen rich is small, the pump is allowed to have a sufficiently small displacement Q of, for example, about 0.5 to 1.0 l/min and the weak point of the viscosity pump poor at a large displacement does not matter. In terms of the above points, the effect of applying the present invention to the refrigerator is extremely great.

When a pump is constructed by applying the present invention to the pump, any type of bearing is applicable. It is possible to apply even the most general ball bearing to uses that have no significant restriction on the operating life, the upper limit of the number of revolutions, and the required level of cleanness. Other magnetic bearings of the active control type or the non-controlled type are also applicable. In this case, a completely oil-free structure can be achieved. Moreover, it is acceptable to apply a thrust support structure of a permanent magnet system only to, for example, the pivot bearing portion.

With regard to the transport grooves that constitute the viscosity pump, two pairs of transport grooves of different directions are formed in the embodiment of the present invention. However, if there is a sufficient margin in the thrust support capability of the bearings, it is acceptable to provide only a one-direction groove. In the structure in which the rotor is supported by a ball bearing, it is easy to provide the construction in which only the one-direction transport groove is formed. In this case, although the flow rate is reduced, the ultimate vacuum pressure of the pump can be increased. Even when two sets of transport grooves are formed, the upper and lower grooves may be asymmetrical to each other.

As another method for reducing the thrust load applied to the rotor, it is acceptable to give an axial load to the rotor by utilizing the pumping effect of the hydrodynamic bearing for a reduction in the thrust load with the pressure of the transport groove. Moreover, it is acceptable to form the transport groove and the hydrodynamic groove of the fluid bearing on either the rotary side or the stationary side. The fluid that can be transported by the pump of the present invention is not limited to air and is allowed to be any kind of gas. Otherwise, liquid is also acceptable.

In the embodiment of the present invention, the transport groove is provided by the viscosity groove. However, depending on the pressure and the flow rate characteristic required by the object of application, it is acceptable to provide, for example, a circumferential groove utilizing the action of a vortex pump. Otherwise, a turbo type centrifugal pump is acceptable. There may be a construction in which this transport groove is provided for a thrust board with a structure similar to that of the third embodiment of the present invention. Otherwise, a construction in which a viscosity pump is combined with a centrifugal pump is acceptable.

When a fluid transport system is constituted by employing the pump of the present invention, it is acceptable to use the pump as a pressurizing pump in place of the reduced pressure pump (vacuum pump). Otherwise, it is acceptable to provide a system construction in which a closed-loop cycle is constituted by employing two sets of pumps of the present invention and using one as a reduced pressure pump and the other one as a pressurizing pump.

When a temperature rise of the discharge fluid becomes an issue, it is proper to provide a heat sink (radiating fins) on the discharge side of the pump. Otherwise, a construction in which radiating fins are provided for the main body of the pump is acceptable. When the pump of the present invention is applied to the oxygen enriching apparatus described in connection with the embodiment, it is acceptable to provide a construction in which the radiating fins are cooled by using an air blower fan for supplying air to the oxygen enriching module.

As a device for obtaining the oxygen-enriched air or the nitrogen-enriched air, it is acceptable to constitute the pump and the fluid transport system of the present invention by using, for example, a hollow fiber membrane system, a PSA (Pressure Swing Adsorption) system, or the like other than the oxygen enriching membrane of the flat membrane type.

By the application of the present invention, there can be obtained a reduced pressure or pressurizing pump that has the following features of:

(1) smallness and compactness;

(2) low vibration and low noise;

(3) long operating life; and (4) capability of constituting an oil-free pump.

Moreover, if the present invention is applied to, for example, a reduced pressure pump of a system for enriching oxygen in the air by using a polymer gas separation membrane (oxygen enriching membrane), the aforementioned features (1) through (4) become the features of the total system. The effects are tremendous.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims unless they depart therefrom.

What is claimed is:

1. A fluid transport system comprising:

a housing:

a rotor housed in said housing;

a fluid transfer chamber formed of said rotor and said housing;

fluid inlet and outlet ports that are formed at said housing, each of said fluid inlet and outlet ports for communicating with said fluid transfer chamber;

a bearing for supporting rotation of said rotor, said fluid transfer chamber and said fluid inlet and outlet ports; and a motor for rotatively driving said rotor, wherein a transport groove for exerting a fluid pumping action on fluid is formed at a relative displacement interface between said rotor and said housing, and wherein two transport grooves of different passages for transporting the fluid are formed at the relative displacement interface.

2. The fluid transport system as claimed in claim 1, comprising a structure for sucking the fluid from a common portion where the two transport grooves are adjacently located, said structure for making the fluid diverge and discharging the fluid through the respective transport grooves.

3. The fluid transport system as claimed in claim 1, wherein the two transport grooves are formed so that pressures at both axial end portions of said rotor become roughly equal to each other.

4. A fluid transport system comprising:

a housing a rotor housed in said housing;

a fluid transfer chamber formed of said rotor and said housing;

fluid inlet and outlet ports that are formed at said housing, each of said fluid inlet and outlet ports for communicating with said fluid transfer chamber;

a bearing for supporting rotation of said rotor, said fluid transfer chamber and said fluid inlet and outlet ports; and a motor for rotatively driving said rotor, wherein a transport groove for exerting a fluid pumping action on fluid is formed at a relative displacement interface between said rotor and said housing, and wherein said bearing is a hydrodynamic fluid bearing.

5. The fluid transport system as claimed in claim 4, wherein said hydrodynamic fluid bearing is a hydrodynamic gas bearing.

6. The fluid transport system as claimed in claim 4, wherein a hydrodynamic groove of said hydrodynamic fluid bearing is formed at a relative displacement interface between an outer surface of a stationary shaft and an inner surface of said rotor.

7. The fluid transport system as claimed in claim 6, wherein a pivot bearing for supporting a thrust direction of said rotor is arranged in an end portion on an opening side of the stationary shaft.

8. The fluid transport system as claimed in claim 4, wherein gas being transported by a pump and gas being used for lubrication of same bearing are a same gas.

9. The fluid transport system as claimed in claim 4, wherein a space in which the transport groove is formed is connected to a space in which said bearing is housed in terms of a fluid path.

* * * * *

UNITED STATES PATENT AND TRADEMARK OFFICE

CERTIFICATE OF CORRECTION

PATENT NO. : 7,118,353 B2
APPLICATION NO. : 10/463601
DATED : October 10, 2006
INVENTOR(S) : Teruo Maruyama et al.

It is certified that error appears in the above-identified patent and that said Letters Patent is hereby corrected as shown below:

ON THE FRONT PAGE

Please add, under Item (21) Appl. No.: 10/463,601,

"(30) Foreign Application Priority Data

June 19, 2002 (JP).....2002-178088".

Signed and Sealed this

Thirteenth Day of February, 2007

JON W. DUDAS
*Director of the United States Patent and Trademark Office*